US011260672B2

(12) United States Patent
Chikamoto

(10) Patent No.: US 11,260,672 B2
(45) Date of Patent: Mar. 1, 2022

(54) LIQUID EJECTING DEVICE

(71) Applicant: Seiko Epson Corporation, Tokyo (JP)

(72) Inventor: Motonori Chikamoto, Shiojiri (JP)

(73) Assignee: Seiko Epson Corporation

( * ) Notice: Subject to any disclaimer, the term of this patent is extended or adjusted under 35 U.S.C. 154(b) by 413 days.

(21) Appl. No.: 15/779,716

(22) PCT Filed: Nov. 25, 2016

(86) PCT No.: PCT/JP2016/084941
§ 371 (c)(1),
(2) Date: May 29, 2018

(87) PCT Pub. No.: WO2017/094609
PCT Pub. Date: Jun. 8, 2017

(65) Prior Publication Data

US 2020/0298587 A1 Sep. 24, 2020

(30) Foreign Application Priority Data

Nov. 30, 2015 (JP) ..... JP2015-233893

(51) Int. Cl.
*B41J 2/21* (2006.01)
*B41J 2/045* (2006.01)

(52) U.S. Cl.
CPC ..... *B41J 2/2142* (2013.01); *B41J 2/04551* (2013.01)

(58) Field of Classification Search
None
See application file for complete search history.

(56) References Cited

U.S. PATENT DOCUMENTS 6,746,095 B2 * 6/2004 Kobayashi ..... B41J 2/16579 347/19
6,758,544 B2 7/2004 Fukano
8,991,957 B2 * 3/2015 Otokita ..... B41J 2/04596 347/10
9,039,116 B2 * 5/2015 Otokita ..... B41J 2/04595 347/11
9,061,491 B2 6/2015 Otokita

FOREIGN PATENT DOCUMENTS

JP 2003-001824 A 1/2003
JP 2015-047737 A 3/2015

* cited by examiner

*Primary Examiner* — Alejandro Valencia
(74) *Attorney, Agent, or Firm* — Harness, Dickey & Pierce, P.L.C.

(57) ABSTRACT

A liquid ejecting device includes: an ejecting section group that includes a plurality of ejecting sections that receive a drive signal and eject a liquid; an ejection state check section that checks a state of a check target ejecting section that is an ejecting section among the plurality of ejecting sections; and a check target designation data management section that manages check target designation data that designates the check target ejecting section, the check target designation data management section including a first data-holding section and a second data-holding section, and having a first management mode in which the check target designation data management section updates data held by the first data-holding section and data held by the second data-holding section, and a second management mode in which the check target designation data management section updates the data held by the second data-holding section without updating the data held by the first data-holding section.

10 Claims, 13 Drawing Sheets

| (SIH-i, SIM-i, SIL-i) | T1 | | | T2 | | | SP-1～SP-30 |
|---|---|---|---|---|---|---|---|
| | Sa-i | Sb-i | Sc-i | Sa-i | Sb-i | Sc-i | |
| (1, 1, 0)[LARGE DOT] | H | L | L | H | L | L | SP-1～SP-6=(1, 0, 0, 1, 0, 0) |
| (1, 0, 0)[MEDIUM DOT] | H | L | L | L | H | L | SP-7～SP-12=(1, 0, 0, 0, 1, 0) |
| (0, 1, 0)[SMALL DOT] | L | L | L | L | H | L | SP-13～SP-18=(0, 0, 0, 0, 1, 0) |
| (0, 0, 0)[NON-RECORDING] | L | H | L | L | L | L | SP-19～SP-24=(0, 1, 0, 0, 0, 0) |
| (0, 0, 1)[CHECK] | L | L | H | L | L | H | SP-25～SP-30=(0, 0, 1, 0, 0, 1) |

| (SIH-i, SIM-i, SIL-i) | T1 | | | T2 | | | SP-1～SP-30 |
|---|---|---|---|---|---|---|---|
| | Sa-i | Sb-i | Sc-i | Sa-i | Sb-i | Sc-i | |
| (1, 1, 0)[LARGE DOT] | H | L | L | H | L | L | SP-1～SP-6=(1, 0, 0, 1, 0, 0) |
| (1, 0, 0)[MEDIUM DOT] | H | L | L | L | H | L | SP-7～SP-12=(1, 0, 0, 0, 1, 0) |
| (0, 1, 0)[SMALL DOT] | L | L | L | L | H | L | SP-13～SP-18=(0, 0, 0, 0, 1, 0) |
| (0, 0, 0)[NON-RECORDING] | L | H | L | L | L | L | SP-19～SP-24=(0, 1, 0, 0, 0, 0) |
| (0, 0, 1)[CHECK] | L | L | H | L | L | H | SP-25～SP-30=(0, 0, 1, 0, 0, 1) |

LIQUID EJECTING DEVICE

TECHNICAL FIELD

The present invention relates to a liquid ejecting device.

BACKGROUND ART

A liquid ejecting device (e.g., inkjet printer) that ejects an ink to print an image or a document may be designed to utilize a piezoelectric element (piezo element). The piezoelectric element is provided to the head unit corresponding to each of a plurality of nozzles, and driven according to a drive signal so that a predetermined amount of ink (liquid) is ejected from each nozzle at a predetermined timing to form a dot on a medium (e.g., paper).

If the ejection state of the nozzle has become abnormal, a normal dot is not formed on the medium, and the quality of the image formed on the medium deteriorates. For example, Patent Literature 1 discloses complementary technology that sequentially checks the state of each nozzle, and, when an abnormal nozzle has been detected, causes a normal nozzle to eject an ink instead of the abnormal nozzle to form a dot.

CITATION LIST

Patent Literature

PTL 1: JP-A-2015-047737

SUMMARY OF INVENTION

Technical Problem

According to the method disclosed in Patent Literature 1, however, since it is necessary to transfer and process data in an amount almost equal to the amount of data transferred during a normal printing operation in order to check each nozzle, the check time increases as the number of nozzles increases due to data transfer and data processing. In particular, when implementing an inkjet printer that has a large number of nozzles and prints an image at a high speed (e.g., line inkjet printer and high-resolution printer), it is important to shorten the check time that increases as the number of nozzles increases.

The invention was conceived in view of the above problems. Several aspects of the invention may provide a liquid ejecting device that can quickly check the state of the ejecting section.

Solution to Problem

The invention was conceived in order to solve at least some of the above problems, and may be implemented as described below (see the following aspects and application examples).

Application Example 1

According to Application Example 1, a liquid ejecting device includes:

an ejecting section group that includes a plurality of ejecting sections that receive a drive signal and eject a liquid;

an ejection state check section that checks a state of a check target ejecting section that is an ejecting section among the plurality of ejecting sections; and a check target designation data management section that manages check target designation data that designates the check target ejecting section, the check target designation data management section including a first data-holding section and a second data-holding section, and having a first management mode in which the check target designation data management section updates data held by the first data-holding section and data held by the second data-holding section, and a second management mode in which the check target designation data management section updates the data held by the second data-holding section without updating the data held by the first data-holding section.

According to the liquid ejecting device, it is possible to shorten the time required to designate the check target ejecting section, and shorten the check cycle by updating the data in the first management mode when performing a normal ejection operation, and updating the data in the second management mode when checking the state of the ejecting section. Therefore, the liquid ejecting device can quickly check the state of the ejecting section.

Application Example 2

In the liquid ejecting device, the check target designation data held by the first data-holding section may be used for selecting an ejecting section to be driven from the plurality of ejecting sections, and the check target designation data held by the second data-holding section may be used for selecting part of the drive signal.

Application Example 3

In the liquid ejecting device, the first data-holding section may be a first shift register, the second data-holding section may be a second shift register, in the first management mode, the check target designation data may be input to the first shift register, the first shift register may shift the input check target designation data, and the second shift register may shift the data output from the first shift register to update the data held by the second shift register, and in the second management mode, the check target designation data may be input to the second shift register, and the second shift register may shift the input check target designation data to update the data held by the second shift register.

According to this configuration, it is possible to shift the check target designation data using the first shift register and the second shift register when the check target designation data management section has been set to the first management mode, and shift the check target designation data using the second shift register without using the first shift register when the check target designation data management section has been set to the second management mode.

Application Example 4

In the liquid ejecting device, the second shift register may be an N-bit (where, N is a natural number equal to or larger than 1) register, in the first management mode, the second shift register may hold the data output from the first shift register in a state in which the data is shifted by N bits, and in the second management mode, the second shift register may hold the input check target designation data in a state in which the check target designation data is shifted by a number of bits that is smaller than N bits.

According to this configuration, it is possible to reduce the shift amount of the check target designation data when the check target designation data management section has been set to the second management mode as compared with the case where the check target designation data management section has been set to the first management mode.

Application Example 5

In the liquid ejecting device, the first data-holding section may be a first shift register, the second data-holding section may be a second shift register, in the first management mode, the second shift register may be connected to the output of the first shift register, and the check target designation data may be input to the first shift register, and in the second management mode, the second shift register may not be connected to the output of the first shift register, and the check target designation data may be input to the second shift register.

According to this configuration, it is possible to shift the check target designation data using the first shift register and the second shift register when the check target designation data management section has been set to the first management mode, and shift the check target designation data using the second shift register without using the first shift register when the check target designation data management section has been set to the second management mode.

Application Example 6

In the liquid ejecting device, the first management mode may be used for the first check, and the second management mode may be used for a consecutive check.

The data held by the first data-holding section and the data held by the second data-holding section are indefinite at a timing before a check is performed. According to the above configuration, it is possible to update the data held by the first data-holding section and the data held by the second data-holding section by utilizing the first management mode. This makes it possible to designate the first check target ejecting section. When the check target designation data management section has been set to the second management mode, it is possible to update the data held by the second data-holding section without updating the data held by the first data-holding section. Since the check target ejecting section can thus be consecutively designated, it is possible to shorten the time required to designate the check target ejecting section, and shorten the check cycle. Therefore, the liquid ejecting device can quickly check the state of the ejecting section.

Application Example 7

In the liquid ejecting device, in the second management mode, the check target designation data management section may update the data held by the second data-holding section so that designation of the check target ejecting section is shifted.

According to this configuration, the designation of the check target ejecting section is shifted by causing the check target designation data management section to update the data held by the second data-holding section when the check target designation data management section has been set to the second management mode. This makes it possible to shorten the time required to designate the check target ejecting section. Therefore, the liquid ejecting device can shorten the check cycle, and quickly check the state of the ejecting section.

Application Example 8

The liquid ejecting device may further include an abnormal ejection state-resolving section that takes measures when the ejection state check section has determined that the state of the check target ejecting section is abnormal.

According to this configuration, since it is possible to take measures when the state of the check target ejecting section is abnormal, it is possible to reduce the amount of waste (products), and improve productivity.

Application Example 9

In the liquid ejecting device, the abnormal ejection state-resolving section may increase the ejection volume of the liquid from an ejecting section among the plurality of ejecting sections other than the check target ejecting section when the ejection state check section has determined that the state of the check target ejecting section is abnormal.

Note that the expression "increase the ejection volume of the liquid" includes a process that sets the ejecting section from a state in which the ejecting section does not eject the liquid (i.e., the ejection volume is 0) to a state in which the ejecting section ejects the liquid (i.e., the ejection volume is other than 0).

According to this configuration, it is possible to deal with a case where the ejection state of the ejecting section is abnormal without stopping production by causing another ejecting section to eject a liquid. Therefore, the liquid ejecting device can reduce the amount of waste (products), improve productivity, and implement high-speed production.

Application Example 10

In the liquid ejecting device, the abnormal ejection state-resolving section may include at least one of a cleaning mechanism, a wiping mechanism, and a complementary recording mechanism.

According to this configuration, since it is possible to take measures using a cleaning process, a wiping process, or a complementary recording process when the state of the ejecting section is abnormal, it is possible to reduce the amount of waste (products), and improve productivity.

DESCRIPTION OF EMBODIMENTS

The exemplary embodiments of the invention are described in detail below with reference to the drawings. Note that the drawings are used for convenience of explanation. The following exemplary embodiments do not unduly limit the scope of the invention as stated in the claims. All of the elements described below should not necessarily be taken as essential elements of the invention.

1. Outline of Liquid Ejecting Device

A printer (i.e., liquid ejecting device) according to one embodiment of the invention is an inkjet printer that forms ink dots on a print medium (e.g., paper) by ejecting an ink corresponding to image data supplied from an external host computer to print an image (including a character, a figure, and the like) corresponding to the image data.

Examples of the liquid ejecting device include a printing device such as a printer, a color material ejecting device that is used to produce a color filter used for a liquid crystal display and the like, an electrode material ejecting device that is used to form an electrode of an organic EL display, a field emission display (FED), and the like, a biological organic substance ejecting device that is used to produce a biochip, and the like.

Figure 1:
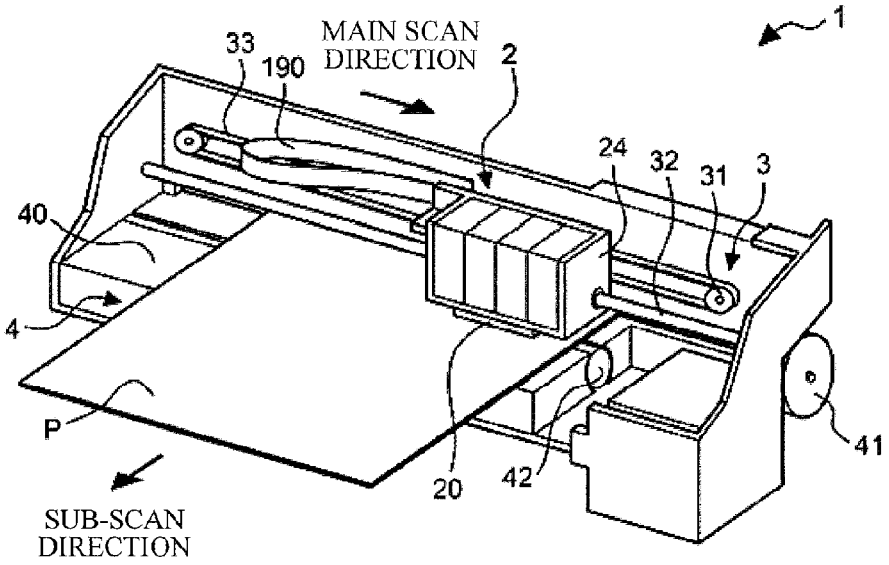
FIG. 1 illustrates a schematic configuration of a liquid ejecting device.

FIG. 1 is a perspective view illustrating a schematic internal configuration of a liquid ejecting device 1. As illustrated in FIG. 1, the liquid ejecting device 1 includes a moving mechanism 3 that moves (reciprocates) a moving element 2 in the main scan direction.

The moving mechanism 3 includes a carriage motor 31 that moves the moving element 2, a carriage guide shaft 32 that is secured at each end, and a timing belt 33 that extends almost parallel to the carriage guide shaft 32, and is driven by the carriage motor 31.

A carriage 24 of the moving element 2 is reciprocally supported by the carriage guide shaft 32, and is secured on part of the timing belt 33. Therefore, when the timing belt 33 is moved forward and backward using the carriage motor 31, the moving element 2 reciprocates while being guided by the carriage guide shaft 32.

A head unit 20 is provided to an area of the moving element 2 that is situated opposite to a print medium P. The head unit 20 ejects an ink droplet (liquid droplet) from a number of nozzles (as described later). Various control signals and the like are supplied to the head unit 20 through a flexible cable 190.

The liquid ejecting device 1 includes a feed mechanism 4 that feeds the print medium P on a platen 40 in the sub-scan direction. The feed mechanism 4 includes a feed motor 41 (i.e., drive source), and a feed roller 42 that is rotated by the feed motor 41, and feeds the print medium P in the sub-scan direction.

The head unit 20 ejects an ink droplet toward the print medium P at a timing at which the print medium P has been fed by the feed mechanism 4 to form an image on the surface of the print medium P.

2. Electrical Configuration of Liquid Ejecting Device

Figure 2:
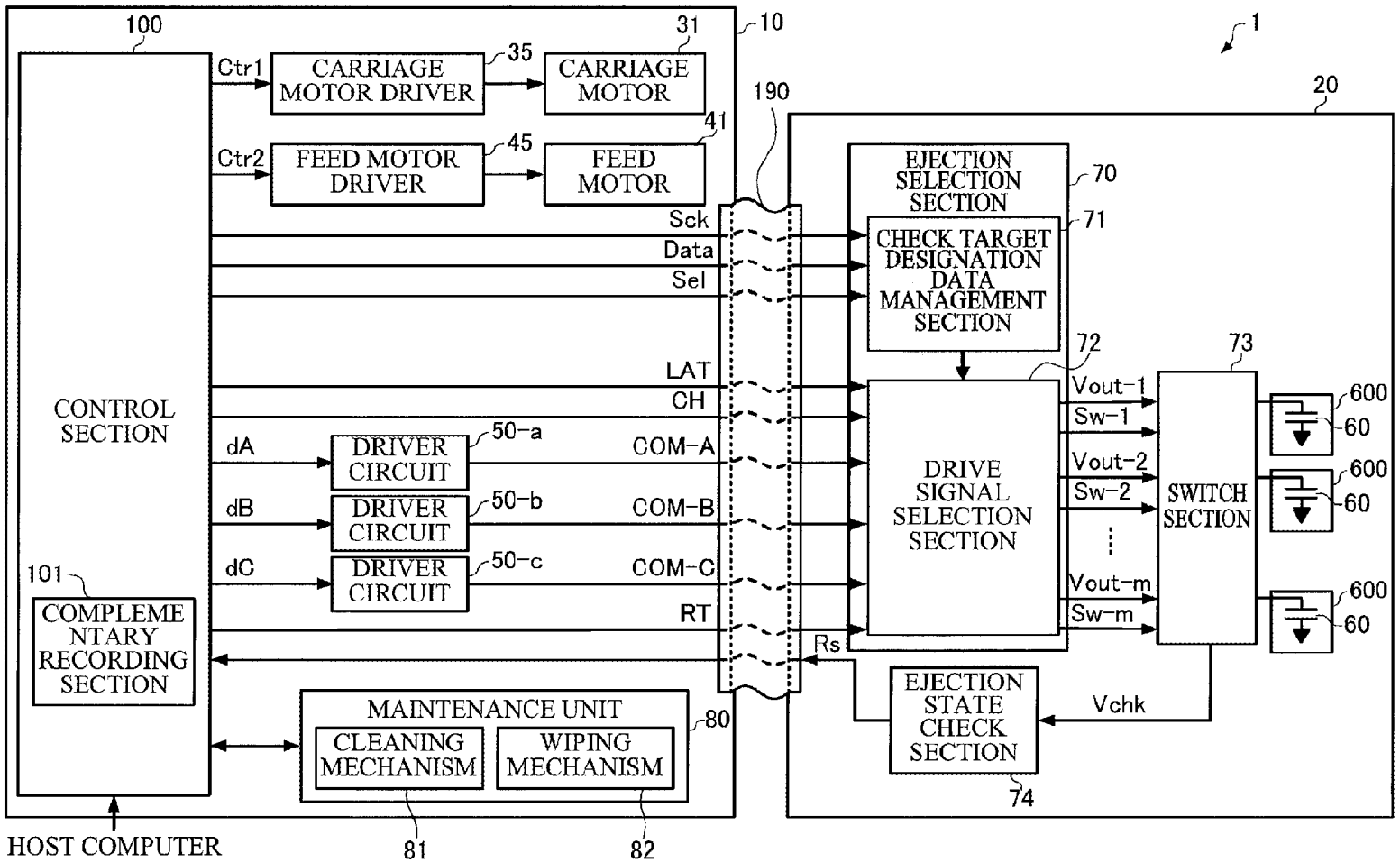
FIG. 2 is a block diagram illustrating the configuration of a liquid ejecting device.

FIG. 2 is a block diagram illustrating the electrical configuration of the liquid ejecting device 1.

As illustrated in FIG. 2, the liquid ejecting device 1 has a configuration in which a control unit 10 and the head unit 20 are connected through the flexible cable 190.

The control unit 10 includes a control section 100, the carriage motor 31, a carriage motor driver 35, the feed motor 41, a feed motor driver 45, a driver circuit 50-*a*, a driver circuit 50-*b*, a driver circuit 50-*c*, and a maintenance unit 80. The control section 100 outputs various control signals and the like that control each section when the image data has been supplied from the host computer.

More specifically, the control section 100 supplies a control signal Ctr1 to the carriage motor driver 35, and the carriage motor driver 35 drives the carriage motor 31 according to the control signal Ctr1. The movement of the carriage 24 in the main scan direction is thus controlled.

The control section 100 supplies a control signal Ctr2 to the feed motor driver 45, and the feed motor driver 45 drives the feed motor 41 according to the control signal Ctr2. The movement of the feed mechanism 4 in the sub-scan direction is thus controlled.

The control section 100 supplies digital data dA to the driver circuit 50-*a*, supplies digital data dB to the driver circuit 50-*b*, and supplies digital data dC to the driver circuit 50-*c*. The data dA represents (defines) the waveform of a drive signal COM-A that is supplied to the head unit 20, the data dB represents (defines) the waveform of a drive signal COM-B that is supplied to the head unit 20, and the data dC represents (defines) the waveform of a drive signal COM-C that is supplied to the head unit 20.

The driver circuit 50-*a* subjects the data dA to digital/analog conversion, subjects the resulting data to class-D amplification, and outputs the resulting drive signal COM-A to the head unit 20. The driver circuit 50-*b* subjects the data dB to digital/analog conversion, subjects the resulting data to class-D amplification, and outputs the resulting drive signal COM-B to the head unit 20. The driver circuit 50-*c* subjects the data dC to digital/analog conversion, subjects the resulting data to class-D amplification, and outputs the resulting drive signal COM-C to the head unit 20. Note that the driver circuits 50-*a*, 50-*b*, and 50-*c* may differ from each other as to only the data input thereto and the drive signal output therefrom, and have an identical circuit configuration.

The control section 100 supplies a clock signal Sck, a data signal Data, and control signals LAT, CH, Sel, and RT for driving a plurality of (m) ejecting sections 600 to the head unit 20 during a print period so that an image corresponding to the image data supplied from the host computer is formed on the surface of the print medium P. The control section 100 supplies the clock signal Sck, the data signal Data, and the control signals LAT, CH, Sel, and RT for checking the state of each ejecting section 600 during a check period (e.g., a period that follows the print period that has ended, and precedes the next print period) that differs from the print period.

The control section 100 may receive a check result signal Rs from the head unit 20, and instruct the maintenance unit 80 to perform a maintenance process that allows the check target ejecting section 600 to recover a normal ink ejection state when the ink ejection state of the check target ejecting section 600 is abnormal.

The maintenance unit 80 may include a cleaning mechanism 81 that performs a cleaning process (pumping process) (i.e., maintenance process) that sucks a viscous ink, air bubbles, and the like from the ejecting section 600 using a tube pump (not illustrated in the drawings). The maintenance unit 80 may include a wiping mechanism 82 that performs a wiping process (i.e., maintenance process) that wipes off a foreign substance (e.g., paper powder) that adheres to the ejecting section 600 in an area around the nozzle using a wiper (not illustrated in the drawings).

The control section 100 may include a complementary recording section 101 that performs a complementary recording process during the print period in addition to, or instead of, the maintenance process when it has been detected that the ejection state of the ejecting section 600 is abnormal, the complementary recording process complementing the recording (printing) of an image on the print medium P using another ejecting section 600 that differs from the ejecting section 600 for which an abnormal ejection state has been detected. When the control section 100 is configured to perform the complementary recording process when it has been detected that the ejection state of the ejecting section 600 is abnormal, it is possible to continue the printing process without performing the maintenance process in a state in which the printing process is stopped.

The head unit 20 includes an ejection selection section 70, a switch section 73, an ejection state check section 74, and an ejecting section group that includes a plurality of ejecting sections 600 (m ejecting sections 600) that receive the drive signal and eject a liquid. Note that the head unit 20 may include the driver circuits 50-*a*, 50-*b*, and 50-*c*.

The ejection selection section 70 receives the clock signal Sck, the data signal Data, and the control signals LAT and CH transmitted from the control section 100. In one embodiment of the invention, the data signal Data includes print data SI and program data SP. The print data SI represents the size (grayscale) of a dot that is formed on the print medium P due to the ejection operation performed by each of the m ejecting sections 600. In one embodiment of the invention, the print data SI represents four grayscales ("large dot", "medium dot", "small dot", and "non-recording (no dot)") (as described later). The program data SP is data that selects a drive pulse (waveform) that is applied to a piezoelectric element 60 included in the ejecting section 600 from the drive signals COM-A and COM-B. Specifically, the data signal Data functions as an ejection selection signal that selects the ejection operation performed by each of the m ejecting sections 600. The control section 100 functions as an ejection selection signal generation section that generates the data signal Data (ejection selection signal). In one embodiment of the invention, the ejection selection section 70 includes a check target designation data management section 71 and a drive signal selection section 72.

The check target designation data management section 71 includes a first data-holding section and a second data-holding section. In one embodiment of the invention, the first data-holding section is a first shift register that holds the program data SP, and the second data-holding section is a second shift register that holds the print data SI.

The check target designation data management section 71 has a first management mode in which the check target designation data management section 71 updates the data held by the first shift register (first data-holding section) and the data held by the second shift register (second data-holding section), and a second management mode in which the check target designation data management section 71 updates the data held by the second shift register (second data-holding section) without updating the data held by the first shift register (first data-holding section). In the first management mode, the second shift register is connected to the output of the first shift register, and the data signal Data is input to the first shift register. In the second management mode, the second shift register is not connected to the output of the first shift register, and the data signal Data is input to the second shift register. Note that the first shift register that holds the program data SP may be referred to as "SP shift register", and the second shift register that holds the print data SI may be referred to as "SI shift register".

The control signal Sel sets the check target designation data management section 71 to either the first management mode or the second management mode. More specifically, the check target designation data management section 71 is set to the first management mode when the control signal Sel is set to a low level, and is set to the second management mode when the control signal Sel is set to a high level.

The check target designation data management section 71 manages the print data SI and the program data SP during the print period. More specifically, the check target designation data management section 71 shifts and holds (manages) the print data SI and the program data SP included in the data signal Data during the print period at the edge timing of the clock signal Sck. Specifically, the control section 100 always transmits the control signal Sel set to a low level during the print period, and the check target designation data management section 71 shifts (by 1 bit) and holds the print data SI and the program data SP included in the data signal Data using the SI shift register and the SP shift register.

The data signal Data includes check target designation data during the check period, the check target designation data designating the ejecting section 600 (check target ejecting section) included in the ejecting section group that is checked by the ejection state check section 74. The check target designation data is classified into first data having a first data format that designates the first ejecting section 600 (check target ejecting section) that is checked when the print period has ended (when the check period has started), and second data having a second data format that designates the ejecting section 600 (check target ejecting section) that is checked after the first ejecting section 600 has been checked.

The print data SI held by the SI shift register and the program data SP held by the SP shift register are indefinite at the end of the print period. Therefore, the first data includes the print data SI and the program data SP in the same manner as the data signal Data used during the print period in order to designate the first ejecting section 600 (check target ejecting section) that is checked when the print period has ended (when the check period has started). In one embodiment of the invention, the program data SP included in the first data is the same as the program data SP that is used during the print period. On the other hand, the print data SI included in the first data is used to select the ejecting section 600 to which the check drive signal is applied, and the ejecting section 600 to which the check drive signal is not applied, and differs from the print data SI that is used during the print period.

The check target designation data management section 71 manages the check target designation data during the check period. In the first management mode during the check period, the check target designation data is input to the first shift register, the first shift register shifts the input check target designation data, and the second shift register shifts the data output from the first shift register to update the data held by the second shift register. In the second management mode during the check period, the check target designation data is input to the second shift register, and the second shift register shifts the input check target designation data to update the data held by the second shift register.

More specifically, when the check target designation data management section 71 has been set to the first management mode during the check period, the check target designation data management section 71 shifts and holds (manages) the first data (print data SI and program data SP) included in the data signal Data at the edge timing of the clock signal Sck. Specifically, the control section 100 transmits the control signal Sel set to a low level together with the data signal Data including the first data and the clock signal Sck during the check period, and the first data is input to the SP shift register. The first data is shifted by 1 bit by the SP shift register and the SI shift register at the edge timing of the clock signal Sck.

Since it is unnecessary to subsequently change the program data SP during the check period, the second data may not include the program data SP. The second data need not include the print data SI. The second data may be data that shifts the designation of the ejecting section 600 (check target ejecting section) that is checked. The second data may represents a fixed value that represents the number of bits corresponding to the shift amount, for example.

When the check target designation data management section 71 has been set to the second management mode during the check period, the check target designation data management section 71 shifts and holds (manages) the second data (e.g., fixed value) included in the data signal Data at the edge timing of the clock signal Sck. Specifically, the control section 100 transmits the control signal Sel set to a high level together with the data signal Data including the second data and the clock signal Sck during the check period, and the second data is input to the SI shift register. The second data is shifted by 1 bit by the SI shift register at the edge timing of the clock signal Sck. For example, when the second data is data that shifts the designation of the ejecting section 600 (check target ejecting section) that is checked, the check target designation data management section 71 updates the data held by the SI shift register in the second management mode so as to shift the designation of the ejecting section 600 (check target ejecting section) that is checked.

The first data includes the print data SI having the number of bits proportional to the number (m) of ejecting section 600 in addition to the program data SP. On the other hand, the second data need not include the program data SP. For example, it suffices that the second data include data having the number of bits proportional to the shift amount by which the check target ejecting section 600 is shifted. When the number of bits of the print data SI is N (where, N is a natural number equal to or larger than 1), the second shift register is an N-bit register. In the first management mode, the second shift register holds the data (i.e., the leading N-bit data included in the check target designation data (first data)) output from the first shift register in a state in which the data is shifted by N bits. In the second management mode, the second shift register holds the input check target designation data (second data) in a state in which the check target designation data is shifted by a number of bits that is smaller than N bits. Since the size of the second data is smaller than that of the first data, and it is possible to significantly shorten the time required for the check target designation data management section 71 to manage the second data, it is possible to check the m ejecting sections 600 more quickly.

The drive signal selection section 72 selects the waveform included in the drive signals COM-A, COM-B, and COM-C based on the data shifted and held (managed) by the check target designation data management section 71, and the control signals LAT, CH, and RT, and applies m drive signals Vout (Vout-1 to Vout-m) that include the selected waveform respectively to the m ejecting sections 600.

More specifically, the drive signal selection section 72 applies the m drive signals Vout (Vout-1 to Vout-m) that respectively correspond to one of the four grayscales ("large dot", "medium dot", "small dot", and "non-recording") respectively to the m ejecting sections 600 during the print period so that an image that corresponds to the image data is formed on the surface of the print medium P. In the check period, the drive signal selection section 72 applies the drive signal Vout that causes the piezoelectric element 60 to vibrate (to such an extent that an ink droplet is not ejected, and it is possible to check whether or not the ejection state is abnormal) to the check target ejecting section 600, and applies the drive signal Vout that corresponds to "non-recording" during the print period to the ejecting section 600 other than the check target ejecting section 600.

The check target designation data (i.e., the program data SP included in the first data) that is held by the SP shift register (i.e., first data-holding section (first shift register)) during the check period is data that selects the drive target ejecting section 600 from a plurality of (m) ejecting sections 600 in order to check whether or not the ejection state of each of the plurality of (m) ejecting sections 600 is abnormal. The check target designation data (i.e., the print data SI or the second data included in the first data) that is held by the SI shift register (i.e., second data-holding section (second shift register)) during the check period is data that selects part of the drive signals COM-A, COM-B, and COM-C.

The drive signal selection section 72 generates m selection signals Sw-1 to Sw-m that control the switch section 73.

The switch section 73 performs a control process during the print period so that the drive signal Vout is continuously applied to the m ejecting sections 600 based on the m selection signals Sw-1 to Sw-m supplied from the drive signal selection section 72. The switch section 73 performs a control process during the check period so that the drive signal Vout is applied to the ejecting section 600 other than the check target ejecting section 600, and the drive signal Vout is also applied to the check target ejecting section 600 to output a residual vibration signal Vchk.

The ejection state check section 74 checks the state of the ejecting section 600. More specifically, the ejection state check section 74 checks the state of the ejecting section 600 (e.g., checks whether or not the ejection state of the check target ejecting section 600 is abnormal) based on the residual vibration signal Vchk from the switch section 73, and outputs a check result signal Rs that represents the check result.

The liquid ejecting device 1 includes at least one of the cleaning mechanism 81, the wiping mechanism 82, and a complementary recording mechanism (complementary recording section 101) as an abnormal ejection state-resolving section that takes measures when the ejection state check section 74 has determined that the state of the check target ejecting section 600 is abnormal. When the ejection state of at least one ejecting section 600 is abnormal, the liquid ejecting device 1 may stop the printing process, and perform the cleaning process using the cleaning mechanism 81, or perform the wiping process using the wiping mechanism 82. When the ejection state of at least one ejecting section 600 is abnormal, the liquid ejecting device 1 may perform the complementary recording process using the complementary recording section 101 when the next print period has started. For example, when the ejection state check section 74 has determined that the ejection state of the check target ejecting section 600 is abnormal, the complementary recording section 101 may perform the complementary recording process that increases the ejection volume of a liquid from the ejecting section 600 other than the check target ejecting section 600. It is possible to continue the printing process while reducing the waste (loss) of paper by performing the complementary recording process using the complementary recording section 101.

Note that the process that increases the ejection volume of a liquid from the ejecting section 600 other than the check target ejecting section 600 includes a process that sets the ejecting section 600 other than the check target ejecting section 600 to a state in which the ejecting section 600 ejects a liquid (i.e., the ejection volume is other than 0) from a state in which the ejecting section 600 does not eject a liquid (i.e., the ejection volume is 0). The process that increases the ejection volume of a liquid from the ejecting section 600 other than the check target ejecting section 600 necessarily includes a process that causes the ejecting section 600 that is not scheduled to eject the ink, to eject the ink by means of the complementary recording process.

3. Configuration of Ejecting Section

Figure 3:
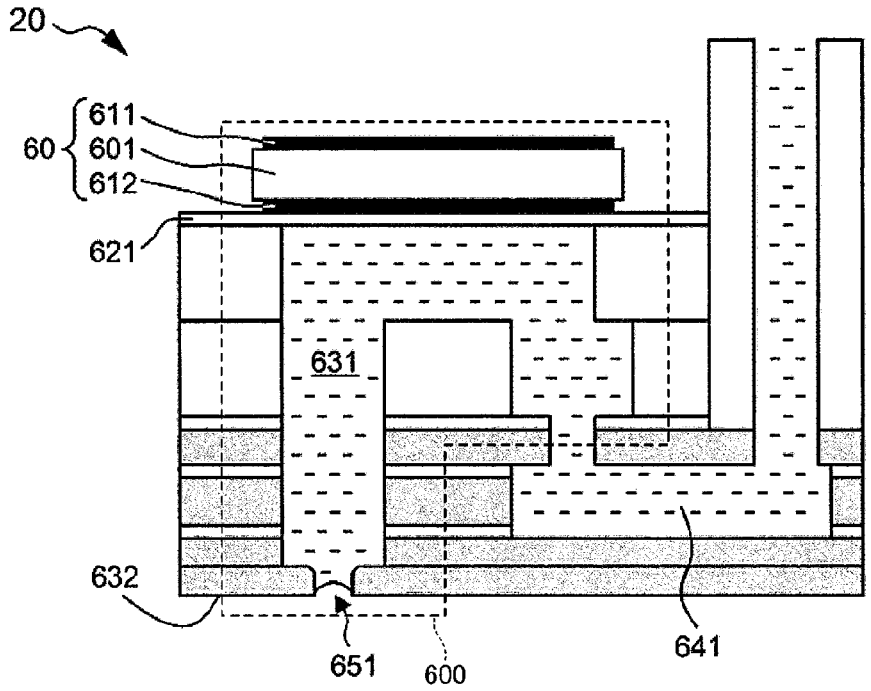
FIG. 3 illustrates the configuration of an ejecting section included in a head unit.

The configuration of the ejecting section 600 that ejects an ink upon application of the drive signal Vout to the piezoelectric element 60, is briefly described below. FIG. 3 illustrates a schematic configuration of the head unit 20 that corresponds to one ejecting section 600.

As illustrated in FIG. 3, the ejecting section 600 included in the head unit 20 includes the piezoelectric element 60, a diaphragm 621, a cavity (pressure chamber) 631, and a nozzle 651. The diaphragm 621 is displaced (produces flexural vibrations) due to the displacement of the piezoelectric element 60 that is provided to the upper side of the diaphragm 621 in FIG. 3 to increase or decrease the internal volume of the cavity 631 that is filled with an ink. The nozzle 651 is a hole (open hole) that is provided to the nozzle plate 632, and communicates with the cavity 631. The cavity 631 is filled with a liquid (e.g., ink), and changes in internal volume due to the displacement of the piezoelectric element 60. The nozzle 651 communicates with the cavity 631, and ejects the liquid contained in the cavity 631 in the form of a liquid droplet (droplet) corresponding to a change in the internal volume of the cavity 631.

The piezoelectric element 60 illustrated in FIG. 3 has a structure in which a piezoelectric material 601 is placed between electrodes 611 and 612 that make a pair. The center part of the piezoelectric material 601 is deformed in the upward-downward direction with respect to each end together with the electrodes 611 and 612 and the diaphragm 621 corresponding to a voltage applied between (through) the electrodes 611 and 612. More specifically, the center part of the piezoelectric element 60 is deformed in the upward direction when the voltage of the drive signal Vout has increased, and is deformed in the downward direction when the voltage of the drive signal Vout has decreased. When the center part of the piezoelectric element 60 is deformed in the upward direction, the internal volume of the cavity 631 increases, and the ink is introduced into the cavity 631 from a reservoir 641. When the center part of the piezoelectric element 60 is deformed in the downward direction, the internal volume of the cavity 631 decreases, and the ink is ejected from the nozzle 651 corresponding to the degree of decrease in the internal volume of the cavity 631.

Note that the structure of the piezoelectric element 60 is not limited to the structure illustrated in FIG. 3. It suffices that the piezoelectric element 60 have such a structure that the piezoelectric element 60 can be deformed to eject a liquid (e.g., ink). The piezoelectric element 60 may be configured to utilize longitudinal vibrations instead of flexural vibrations.

4. Relationship Between Abnormal Ejection State of Ejecting Section and Residual Vibrations There may be a case where an ink droplet is not normally ejected from the nozzle 651 (i.e., an abnormal ejection state occurs) when the ejecting section 600 has performed an ink droplet ejection operation. An abnormal ejection state may occur (1) when air bubbles have been formed within (have entered) the cavity 631, or (2) when the ink within the cavity 631 has increased in viscosity or become immobilized due to drying or the like, or (3) when a foreign substance (e.g., paper powder) has adhered to an area around the outlet of the nozzle 651, for example.

When air bubbles have been formed within the cavity 631, it is considered that the total weight of the ink with which the cavity 631 is filled decreases, and a decrease in inertance occurs. When air bubbles adhere to an area around the nozzle 651, it is considered that the diameter of the nozzle 651 apparently increases by the diameter of the air bubbles, and a decrease in acoustic resistance occurs. Therefore, the frequency of residual vibrations increases when air bubbles have been formed within the cavity 631 (i.e., when the ejection state is abnormal) as compared with the case where the ejection state is normal. Moreover, the attenuation rate of the amplitude of residual vibrations decreases due to a decrease in acoustic resistance.

When the ink has become immobilized in an area around the nozzle 651 due to drying, the ink is confined in the cavity 631. In this case, it is considered that an increase in acoustic resistance occurs. Therefore, the frequency of residual vibrations increases, and residual vibrations are over-attenuated when the ink has become immobilized in an area around the nozzle 651 within the cavity 631 as compared with the case where the ejection state is normal.

When a foreign substance (e.g., paper powder) has adhered to an area around the outlet of the nozzle 651, it is considered that an increase in inertance occurs since the ink flows out from the cavity 631 through the foreign substance (e.g., paper powder). It is also considered that an increase in acoustic resistance occurs due to the paper powder (fiber) that has adhered to an area around the outlet of the nozzle 651. Therefore, the frequency of residual vibrations decreases when a foreign substance (e.g., paper powder) has adhered to an area around the outlet of the nozzle 651 as compared with the case where the ejection state is normal.

Therefore, the ejection state check section 74 can check whether or not an abnormal ejection state has occurred based on the frequency of the residual vibration signal Vchk and the attenuation rate (attenuation time) of the amplitude of the residual vibration signal Vchk to output the check result signal Rs that represents the check result.

5. Drive Signals Supplied to Ejecting Section

Figure 4A:
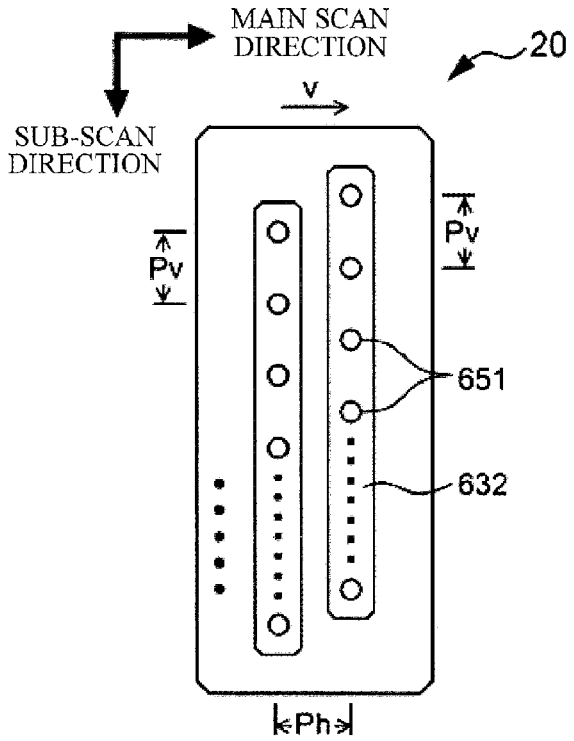
FIG. 4A illustrates the nozzle arrangement of a head unit.

FIG. 4A illustrates an example of the arrangement of the nozzles 651. As illustrated in FIG. 4A, the nozzles 651 are arranged in two rows, for example. More specifically, a plurality of nozzles 651 arranged in each row along the sub-scan direction at a pitch Pv, and a plurality of nozzles 651 arranged in the left row and a plurality of nozzles 651 arranged in the right row are situated away from each other in the main scan direction by a pitch Ph, and are shifted in the sub-scan direction by half of the pitch Pv.

The nozzles 651 are arranged along the main scan direction in a pattern corresponding to each color (e.g., C (cyan), M (Magenta), Y (yellow), and K (black)) when printing a color image, for example. Note that an example in which the grayscale is represented using a single color is described below for convenience of explanation.

Figure 4B:
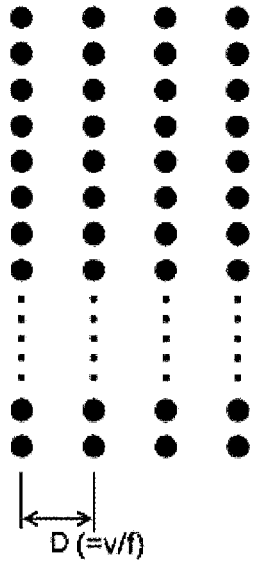
FIG. 4B illustrates the basic resolution when forming an image using the nozzle arrangement illustrated in FIG. 4A.

FIG. 4B illustrates the basic resolution when forming an image using the nozzle arrangement illustrated in FIG. 4A. Note that FIG. 4B illustrates an example of a method (first method) that ejects one ink droplet from the nozzle 651 to form one dot for convenience of explanation. Each black circle represents a dot that is formed by an ink droplet.

When the head unit 20 is moved in the main scan direction at a speed v, the dot-to-dot distance D (in the main scan direction) between dots formed by ink droplets (see FIG. 4B) and the speed v have the relationship described below.

Specifically, when one dot is formed by ejecting one ink droplet, the dot-to-dot distance D is represented by a value (=v/f) calculated by dividing the speed v by the ink ejection frequency f (i.e., the moving distance of the head unit 20 in a cycle (1/f) in which an ink droplet is repeatedly ejected).

In the example illustrated in FIGS. 4A and 4B, the pitch Ph has a proportional relationship with the dot-to-dot distance D with respect to a coefficient n so that ink droplets ejected from the nozzles 651 arranged in two rows are placed on the print medium P to form one row. Therefore, the dot-to-dot distance in the sub-scan direction is half of the dot-to-dot distance in the main scan direction (see FIG. 4B). Note that the dot arrangement is not limited to the example illustrated in FIG. 4B.

High-speed printing can be implemented by increasing the speed v at which the head unit 20 is moved in the main scan direction. However, the dot-to-dot distance D increases when the speed v is merely increased. Therefore, it is necessary to increase the number of dots that are formed per unit time by increasing the ink ejection frequency f in order to implement high-speed printing while providing a certain resolution.

The resolution can be increased by increasing the number of dots that are formed per unit area. In this case, however, adjacent dots may unite when the amount of ink is large, and the print speed may decrease when the ink ejection frequency f is low.

Specifically, it is necessary to increase the ink ejection frequency f in order to implement high-speed and high-resolution printing.

A dot may be formed on the print medium P using a method that ejects one ink droplet to form one dot, a method (second method) that ejects one or more (two or more) ink droplets within a unit period so that the ink droplets unite on the print medium to form one dot, or a method (third method) that ejects two or more ink droplets within a unit period so that the ink droplets do not unite on the print medium to form two or more dots.

In one embodiment of the invention, one or two ink droplets are ejected corresponding to one dot using the second method to implement four grayscales ("large dot", "medium dot", "small dot", and "non-recording (no dot)"). In one embodiment of the invention, the drive signals COM-A and COM-B are provided so as to include a first-half pattern and a second-half pattern within one cycle in order to represent the four grayscales. The drive signal COM-A or COM-B is selected (or the drive signals COM-A and COM-B are not selected) according to the target grayscale in each of the first-half period and the second-half period within one cycle, and supplied to the piezoelectric element 60. In one embodiment of the invention, the drive signal COM-C is provided in addition to the drive signals COM-A and COM-B in order to generate the drive signal Vout that corresponds to "check".

Figure 5:
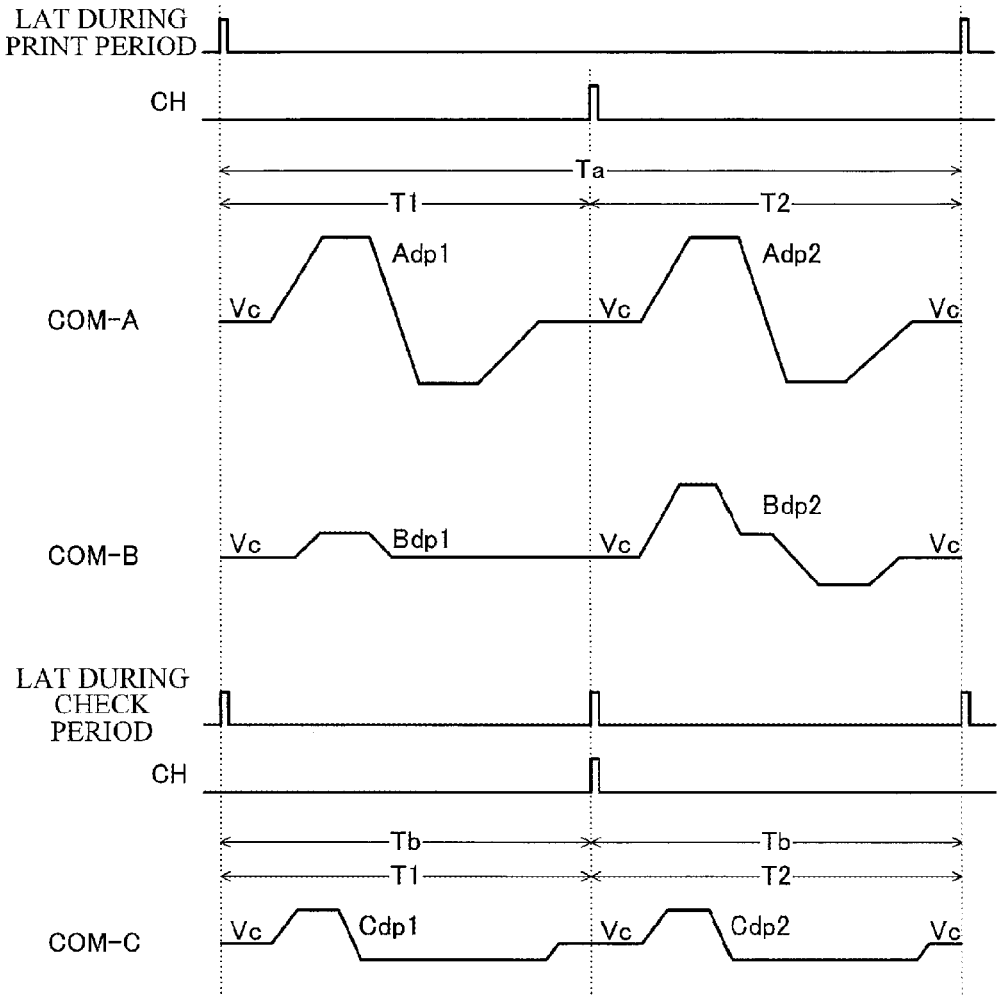
FIG. 5 illustrates the waveforms of drive signals COM-A, COM-B, and COM-C.

FIG. 5 illustrates the waveforms of the drive signals COM-A, COM-B, and COM-C. As illustrated in FIG. 5, the drive signal COM-A has a waveform in which a trapezoidal waveform Adp1 and a trapezoidal waveform Adp2 are provided sequentially, the trapezoidal waveform Adp1 being provided in a period T1 that starts at the rising edge of the control signal LAT and ends at the rising edge of the control signal CH, and the trapezoidal waveform Adp2 being provided in a period T2 that starts at the rising edge of the control signal CH and ends at the rising edge of the control signal LAT. A print cycle Ta consists of the periods T1 and T2, and a new dot is formed on the print medium P in each cycle Ta.

In one embodiment of the invention, the trapezoidal waveforms Adp1 and Adp2 are almost identical to each other. When each of the trapezoidal waveforms Adp1 and Adp2 is supplied to one end of the piezoelectric element 60, a predetermined amount (i.e., medium amount) of ink is ejected from the nozzle 651 that corresponds to the piezoelectric element 60.

The drive signal COM-B has a waveform in which a trapezoidal waveform Bdp1 that is provided in the period T1 and a trapezoidal waveform Bdp2 that is provided in the period T2 are provided sequentially. In one embodiment of the invention, the trapezoidal waveforms Bdp1 and Bdp2 differ from each other. The trapezoidal waveform Bdp1 is a waveform that prevents an increase in the viscosity of the ink by finely vibrating the ink that is situated in the vicinity of the opening of the nozzle 651. Therefore, when the trapezoidal waveform Bdp1 is supplied to one end of the piezoelectric element 60, an ink droplet is not ejected from the nozzle 651 that corresponds to the piezoelectric element 60. The trapezoidal waveform Bdp2 differs from the trapezoidal waveform Adp1 (Adp2). When the trapezoidal waveform Bdp2 is supplied to one end of the piezoelectric element 60, the ink is ejected from the nozzle 651 that corresponds to the piezoelectric element 60 in an amount smaller than the predetermined amount.

The drive signal COM-C has a waveform in which a trapezoidal waveform Cdp1 that is provided in the period T1 and a trapezoidal waveform Cdp2 that is provided in the period T2 are provided sequentially. In one embodiment of the invention, the trapezoidal waveforms Cdp1 and Cdp2 are identical to each other. The trapezoidal waveforms Cdp1 and Cdp2 are a waveform that produces the desired residual vibrations required for a check by vibrating the ink that is situated in the vicinity of the opening of the nozzle 651. When the trapezoidal waveforms Cdp1 and Cdp2 are supplied to one end of the piezoelectric element 60, an ink droplet is not ejected from the nozzle 651 that corresponds to the piezoelectric element 60. In one embodiment of the invention, the control signal LAT is supplied from the control section 100 simultaneously with the control signal CH during the check period (see FIG. 5). Specifically, a check cycle Tb corresponds to the period T1 that starts at the rising edge of the control signal LAT and ends at the rising edge of the control signal CH (and the control signal LAT), or the period T2 that starts at the rising edge of the control signal CH (and the control signal LAT) and ends at the rising edge of the control signal LAT. The check cycle Tb is half of the print cycle Ta. The trapezoidal waveform Cdp1 is sequentially supplied to the piezoelectric elements 60 respectively provided to the m ejecting sections 600 during the period T1 (cycle Tb), or the trapezoidal waveform Cdp2 is sequentially supplied to the piezoelectric elements 60 respectively provided to the m ejecting sections 600 during the period T2 (cycle Tb), to sequentially check the state of the m ejecting sections 600.

Note that the voltage at the start timing of the trapezoidal waveforms Adp1, Adp2, Bdp1, Bdp2, Cdp1, and Cdp2 and the voltage at the end timing of the trapezoidal waveforms Adp1, Adp2, Bdp1, Bdp2, Cdp1, and Cdp2 are identical (i.e., voltage Vc). Specifically, the trapezoidal waveforms Adp1, Adp2, Bdp1, Bdp2, Cdp1, and Cdp2 start at the voltage Vc, and end at the voltage Vc.

The drive signal selection section 72 combines the waveform of one of the drive signals COM-A, COM-B, and COM-C that corresponds to the period T1 and the waveform of one of the drive signals COM-A, COM-B, and COM-C that corresponds to the period T2 based on the data signal Data shifted and held (managed) by the check target designation data management section 71, and the control signals LAT and CH, to generate the drive signals Vout (Vout-1 to Vout-m) that are respectively applied to the m ejecting sections 600, and correspond to "large dot", "medium dot", "small dot", "non-recording", or "check".

Figure 6:
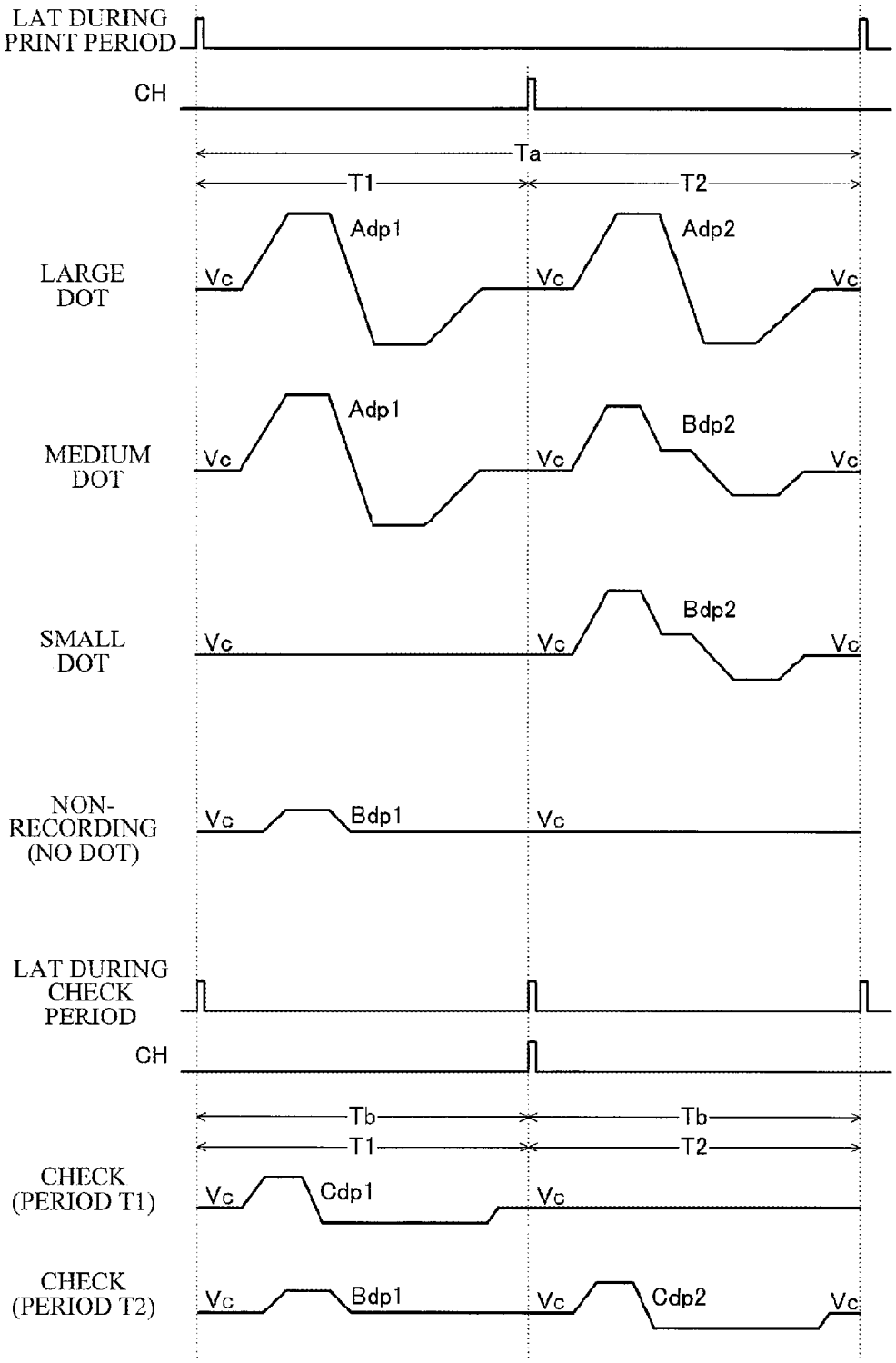
FIG. 6 illustrates the waveform of a drive signal Vout.

FIG. 6 illustrates the waveform of the drive signals Vout that respectively correspond to "large dot", "medium dot", "small dot", "non-recording", and "check".

As illustrated in FIG. 6, the drive signal Vout that corresponds to "large dot" has a waveform that includes the trapezoidal waveform Adp1 of the drive signal COM-A that corresponds to the period T1, and the trapezoidal waveform Adp2 of the drive signal COM-A that corresponds to the period T2, the trapezoidal waveforms Adp1 and Adp2 being provided sequentially. When the drive signal Vout that corresponds to "large dot" is supplied to one end of the piezoelectric element 60, a medium amount of ink (ink droplet) is ejected twice from the nozzle 651 that corresponds to the piezoelectric element 60 in the cycle Ta. The ink droplets thus ejected are placed on the print medium P, and unite to form a large dot.

The drive signal Vout that corresponds to "medium dot" has a waveform that includes the trapezoidal waveform Adp1 of the drive signal COM-A that corresponds to the period T1, and the trapezoidal waveform Bdp2 of the drive signal COM-B that corresponds to the period T2, the trapezoidal waveforms Adp1 and Bdp2 being provided sequentially. When the drive signal Vout that corresponds to "medium dot" is supplied to one end of the piezoelectric element 60, a medium amount of ink (ink droplet) and a small amount of ink (ink droplet) are separately ejected from the nozzle 651 that corresponds to the piezoelectric element 60 in the cycle Ta. The ink droplets thus ejected are placed on the print medium P, and unite to form a medium dot.

The drive signal Vout that corresponds to "small dot" is maintained at the voltage Vc during the period T1 due to the capacitive characteristics of the piezoelectric element 60, and has the trapezoidal waveform Bdp2 of the drive signal COM-B during the period T2. When the drive signal Vout that corresponds to "small dot" is supplied to one end of the piezoelectric element 60, a small amount of ink (ink droplet) is ejected from the nozzle 651 that corresponds to the piezoelectric element 60 only during the period T2 in the cycle Ta. The ink droplet thus ejected is placed on the print medium P to form a small dot.

The drive signal Vout that corresponds to "non-recording" has the trapezoidal waveform Bdp1 of the drive signal COM-B during the period T1, and is maintained at the voltage Vc during the period T2 due to the capacitive characteristics of the piezoelectric element 60. When the drive signal Vout that corresponds to "non-recording" is supplied to one end of the piezoelectric element 60, the nozzle 651 that corresponds to the piezoelectric element 60 is finely vibrated during the period T2 in the cycle Ta, and no ink (ink droplet) is ejected. Therefore, no ink droplet is placed (i.e., no dot is formed) on the print medium P.

The drive signal Vout that corresponds to "check" differs from the drive signal that corresponds to the ejecting section 600 that is checked during the period T1 (hereinafter referred to as "period T1 check drive signal"), and the drive signal that corresponds to the ejecting section 600 that is checked during the period T2 (hereinafter referred to as "period T2 check drive signal"). The period T1 check drive signal Vout has the trapezoidal waveform Cdp1 of the drive signal COM-C during the period T1, and is maintained at the voltage Vc during the period T2 due to the capacitive characteristics of the piezoelectric element 60. The period T2 check drive signal Vout has a waveform that includes the trapezoidal waveform Bdp1 of the drive signal COM-B that corresponds to the period T1, and the trapezoidal waveform Cdp2 of the drive signal COM-C that corresponds to the period T2, the trapezoidal waveforms Bdp1 and Cdp2 being provided sequentially. In one embodiment of the invention, half of the m ejecting sections 600 are checked during the period T1, and the remaining half of the m ejecting sections 600 are checked during the period T2. When the period T1 check drive signal Vout is supplied to one end of the piezoelectric element 60, the nozzle 651 that corresponds to the piezoelectric element 60 is vibrated during the period T1 to produce residual vibrations, but does not eject the ink (ink droplet). When the period T2 check drive signal Vout is supplied to one end of the piezoelectric element 60, the nozzle 651 that corresponds to the piezoelectric element 60 is finely vibrated during the period T1, and is vibrated during the period T2 to produce residual vibrations, but does not eject the ink (ink droplet) during the period T1 and the period T2. In one embodiment of the invention, the drive signal Vout that corresponds to "non-recording" is applied to all of the ejecting sections 600 other than the check target ejecting section 600.

In one embodiment of the invention, the print data SI is 3m-bit data that includes 3-bit print data (SIH, SIM, SIL) corresponding to each of the m ejecting sections 600. More specifically, the pint data SI includes m-bit print data SIH-1 to SIH-m, m-bit print data SIM-1 to SIM-m, and m-bit print data SIL-1 to SIL-m.

In one embodiment of the invention, the program data SP is 30-bit data that includes 6-bit data that defines selection/non-selection of the waveform of each of the drive signals COM-A, COM-B, and COM-C that corresponds to the period T1, and selection/non-selection of the waveform of each of the drive signals COM-A, COM-B, and COM-C that corresponds to the period T2 corresponding to each of "large dot", "medium dot", "small dot", "non-recording", and "check".

The check target designation data management section 71 shifts the data signal Data by 1 bit at the edge timing of the clock signal Sck so that the 3m-bit print data SI is held by the 3m-bit SI shift register, and the 30-bit program data SP is held by the 30-bit SP shift register.

The drive signal selection section 72 causes a 3m-bit SI latch to receive and hold the 3m-bit print data SI held by the 3m-bit SI shift register of the check target designation data management section 71 at the edge timing of the control signal LAT. Likewise, the drive signal selection section 72 causes a 30-bit SP latch to receive and hold the 30-bit program data SP held by the 30-bit SP shift register of the check target designation data management section 71 at the edge timing of the control signal LAT. The drive signal selection section 72 selects the waveform included in the drive signals COM-A and COM-B based on the print data SI held by the SI latch and the program data SP held by the SP latch, and applies the m drive signals Vout-1 to Vout-m that include the selected waveform respectively to the m ejecting sections 600.

6. Configuration of Ejection Selection Section

Figure 7:
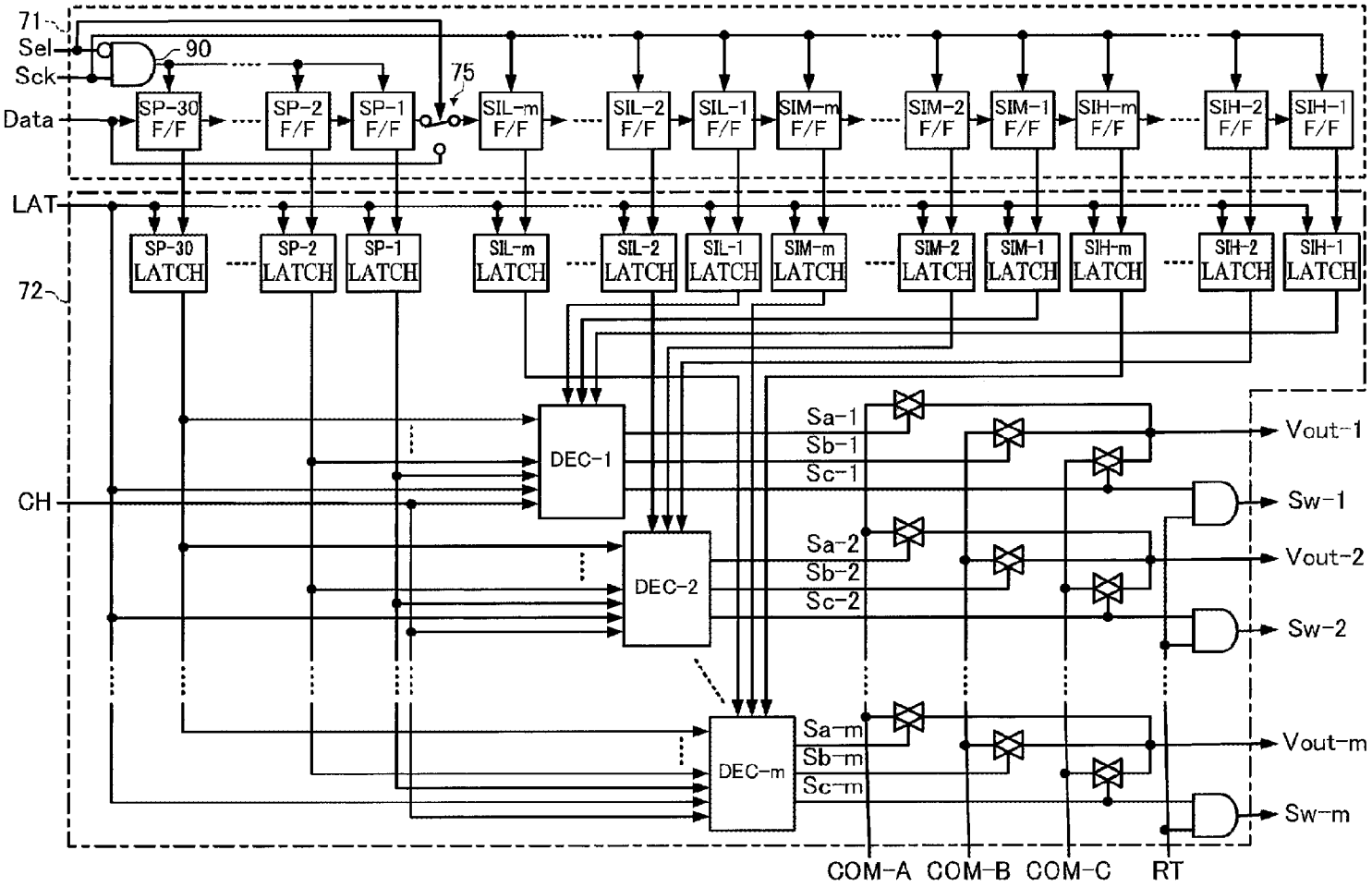
FIG. 7 illustrates the configuration of an ejection selection section.

FIG. 7 illustrates the configuration of the ejection selection section 70. As illustrated in FIG. 7, the check target designation data management section 71 included in the ejection selection section 70 includes a 30-bit SP shift register that includes thirty flip-flops (F/F) that hold the 30-bit program data SP (SP-1 to SP-30). The data signal Data is input to the first-stage flip-flop (F/F) of the SP shift register that holds the program data SP-30. The clock signal Sck is input in common to the thirty flip-flops of the SP shift register in the first management mode (in which the control signal Sel is set to a low level). The clock signal Sck is not input to the thirty flip-flops of the SP shift register in the second management mode (in which the control signal Sel is set to a high level) since the clock signal Sck is masked by an AND circuit 90. Specifically, the SP shift register receives and holds (manages) the data signal Data while shifting the data signal Data by 1 bit at the edge timing of the clock signal Sck in the first management mode (in which the control signal Sel is set to a low level), and holds (manages) the program data SP in the second management mode (in which the control signal Sel is set to a high level) without receiving the data signal Data. Therefore, the data held by the SP shift register is updated in the first management mode (since the data signal Data is shifted), and is not updated in the second management mode.

The check target designation data management section 71 includes an m-bit SIH shift register that includes m flip-flops (F/F) that respectively hold the m-bit print data SIH-1 to SIH-m included in the 3m-bit print data SI. Likewise, the check target designation data management section 71 includes an m-bit SIM shift register that includes m flip-flops (F/F) that respectively hold the m-bit print data SIM-1 to SIM-m included in the 3m-bit print data SI, and an m-bit SIL shift register that includes m flip-flops (F/F) that respectively hold the m-bit print data SIL-1 to SIL-m included in the 3m-bit print data SI. The m-bit SIM shift register is connected to the output of the m-bit SIL shift register, and the m-bit SIH shift register is connected to the output of the m-bit SIM shift register to form a 3m-bit SI shift register. The clock signal Sck is input in common to the 3m flip-flops included in the 3m-bit SI shift register.

The 3m-bit SI shift register is provided at the output of the 30-bit SP shift register through a switch 75. The switch 75 connects the SI shift register to the output of the SP shift register in the first management mode (in which the control signal Sel is set to a low level). The output signal from the final-stage flip-flop (F/F) of the SP shift register that holds the program data SP-1 can thus be input to the first-stage flip-flop (F/F) of the SI shift register that holds the print data SIL-m. The switch 75 does not connect the SI shift register to the output of the SP shift register in the second management mode (in which the control signal Sel is set to a high level), and the data signal Data is input to the first-stage flip-flop (F/F) of the SI shift register that holds the print data SIL-m. Specifically, the SI shift register receives and holds (manages) the output signal from the final-stage flip-flop (F/F) of the SP shift register in the first management mode (in which the control signal Sel is set to a low level) while shifting the output signal at the edge timing of the clock signal Sck, and receives and holds (manages) the data signal Data in the second management mode (in which the control signal Sel is set to a high level). Therefore, the data held by the SI shift register is updated in the first management mode and the second management mode (since the data signal Data is shifted).

In one embodiment of the invention, the data signal Data transmitted from the control section 100 in each cycle Ta includes the 3m-bit print data SI and the 30-bit program data SP, and the control signal Sel transmitted from the control section 100 is always set to a low level during the print period. The clock signal Sck that includes (3m+30) pulses is transmitted from the control section 100 in synchronization with the data signal Data. Therefore, the check target designation data management section 71 is set to the first management mode, the SI shift register holds (manages) the 3m-bit print data SI, and the SP shift register holds (manages) the 30-bit program data SP at the timing of the last ((3m+30)th) pulse included in the clock signal Sck.

In one embodiment of the invention, the data signal Data transmitted from the control section 100 includes the first data that includes the 3m-bit print data SI and the 30-bit program data SP as the check target designation data at a timing immediately before transition from the print period to the check period occurs (or a timing immediately after transition from the print period to the check period has occurred), and the control signal Sel transmitted from the control section 100 at the same timing as the first data is set to a low level. The clock signal Sck that includes (3m+30) pulses is transmitted from the control section 100 in synchronization with the first data. Therefore, the check target designation data management section 71 is set to the first management mode, the SI shift register holds (manages) the 3m-bit print data SI, and the SP shift register holds (manages) the 30-bit program data SP at the timing of the last edge timing of the clock signal Sck. In one embodiment of the invention, the mth ejecting section 600 is the first check target, and the print data (SIH-m, SIM-m, SIL-m) included in the print data SI is (0, 0, 1) that corresponds to "check" (see FIG. 10). The first to (m−1)th ejecting sections 600 are not the check target, and the print data (SIH-j, SIM-j, SIL-j) (j=1 to m−1) is (0, 0, 0) that corresponds to "non-recording" (see FIG. 10).

When the cycle Tb has elapsed during the check period, the data signal Data that includes the 1-bit second data (fixed value "0") that is fixed at a low level (0) is transmitted from the control section 100, and the clock signal Sck that includes one pulse is transmitted from the control section 100 in synchronization with the second data. The control signal Sel that is transmitted from the control section 100 at the same timing as the second data is set to a high level. Therefore, the check target designation data management section 71 is set to the second management mode, and the print data SI held by the SI shift register is shifted by 1 bit, and held (managed) so that the (m−1)th ejecting section 600 is set to the check target instead of the mth ejecting section 600. Specifically, the print data (SIH-(m−1), SIM-(m−1), SIL-(m−1)) included in the print data held by the SI shift register is (0, 0, 1) that corresponds to "check" (see FIG. 10), and the print data (SIH-j, SIM-j, SIL-j) (j=1 to m−2, m) is (0, 0, 0) that corresponds to "non-recording" (see FIG. 10). The same signal as described above is subsequently transmitted from the control section 100 in each cycle Tb during the check period, and the print data SI is held (managed) by the SI shift register so that the m ejecting sections 600 are sequentially set to the check target.

As illustrated in FIG. 7, the drive signal selection section 72 included in the ejection selection section 70 includes a 30-bit SP latch that includes SP-1 to SP-30 latches. The drive signal selection section 72 also includes an m-bit SIL latch that includes SIL-1 to SIL-m latches, an m-bit SIM latch that includes SIM-1 to SIM-m latches, and an m-bit SIH latch that includes SIH-1 to SIH-m latches. The control signal LAT is input in common to the SP-1 to SP-30 latches included in the SP latch, the SIL-1 to SIL-m latches included in the SIL latch, the SIM-1 to SIM-m latches included in the SIM latch, and the SIH-1 to SIH-m latches included in the SIH latch.

The program data SP (SP-1-SP-30) held by (stored in) the SP shift register included in the check target designation data management section 71 is input to the SP latch (SP-1 to SP-30 latches) at the edge timing of the control signal LAT. Likewise, the m-bit print data SIL (SIL-1 to SIL-m) held by (stored in) the SIL shift register is input to the SIL latch (SIL-1 to SIL-m latches) at the edge timing of the control signal LAT, the m-bit print data SIM (SIM-1 to SIM-m) held by (stored in) the SIM shift register is input to the SIM latch (SIM-1 to SIM-m latches) at the edge timing of the control signal LAT, and the m-bit print data SIH (SIH-1 to SIH-m) held by (stored in) the SIH shift register is input to the SIH latch (SIH-1 to SIH-m latches) at the edge timing of the control signal LAT.

The control section 100 transmits the pulse of the control signal LAT in each print cycle Ta during the print period, and transmits the pulse of the control signal LAT in each check cycle Tb during the check period. Therefore, the program data SP held by the SP latch, the print data SIL held by the SIL latch, the print data SIM held by the SIM latch, and the print data SIH held by the SIH latch are updated in each print cycle Ta or each check cycle Tb based on the control signal LAT.

Figure 8:
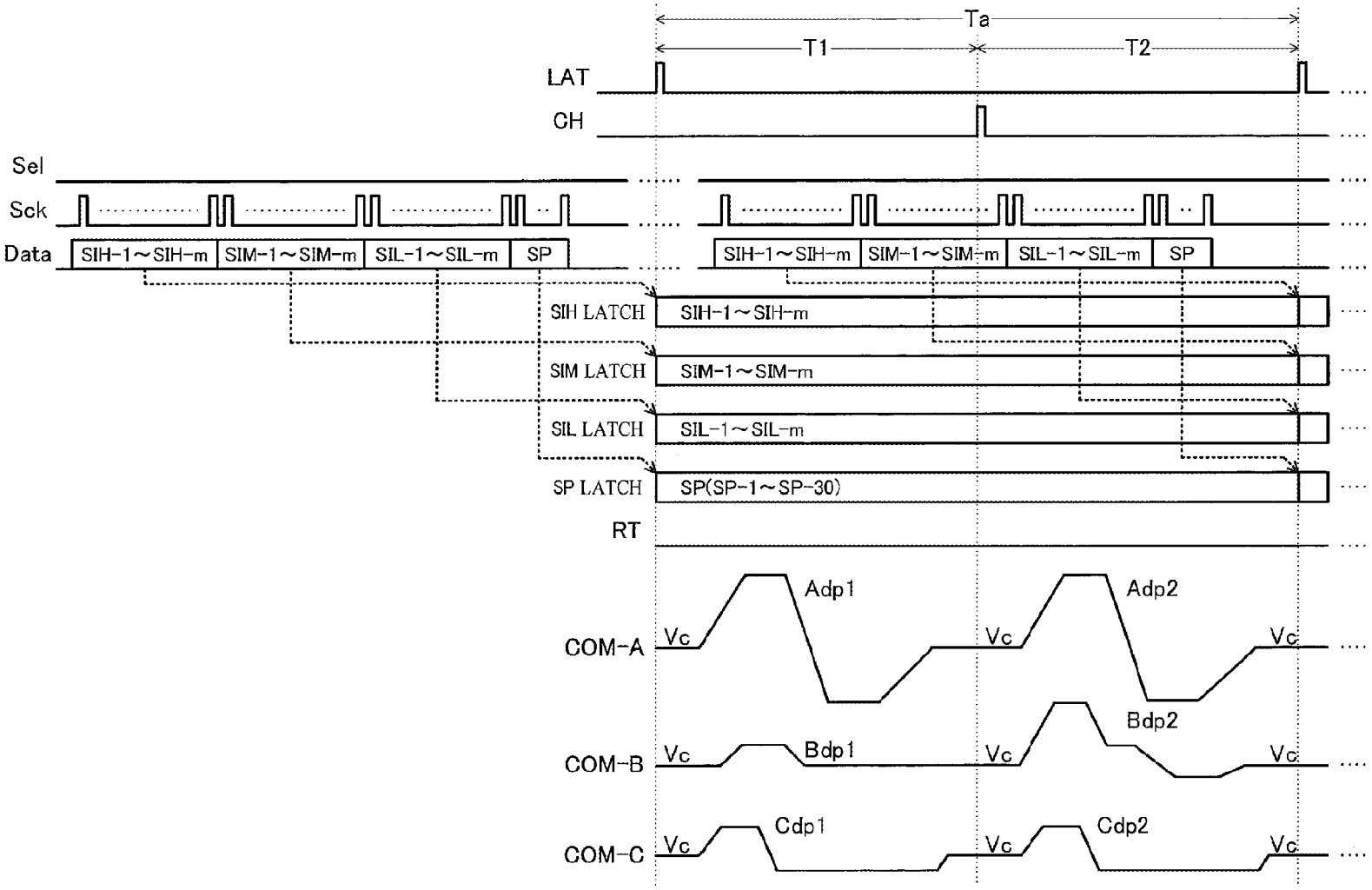
FIG. 8 illustrates the waveform of each signal supplied to a head unit, and the update timing of each latch during a print period.
Figure 9:
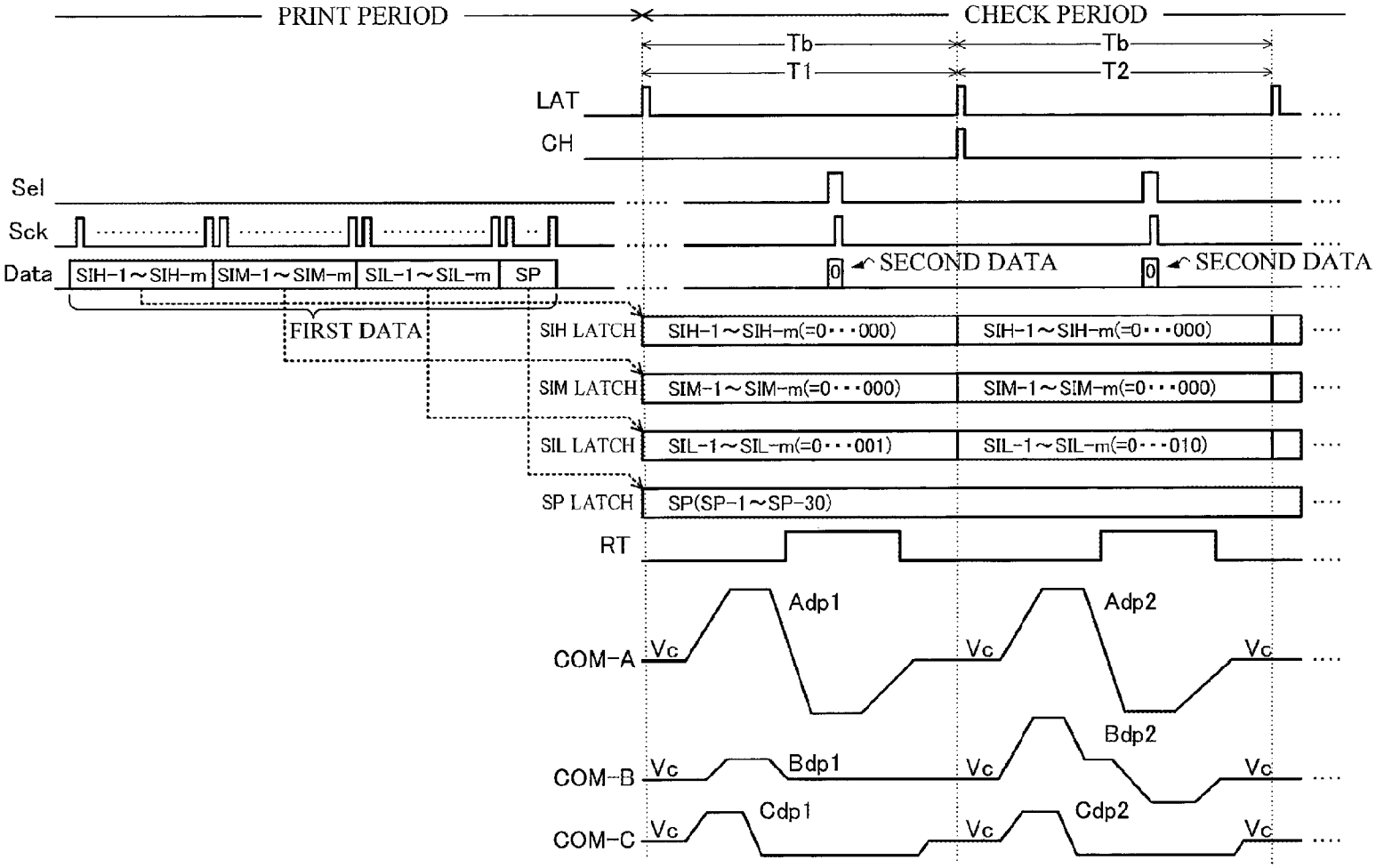
FIG. 9 illustrates the waveform of each signal supplied to a head unit, and the update timing of each latch before and after transition from a print period to a check period.

FIG. 8 illustrates the waveform of each signal supplied to the head unit 20 from the control unit 10, and the update timing of the SP latch, the SIL latch, the SIM latch, and the SIH latch during the print period. FIG. 9 illustrates the waveform of each signal supplied to the head unit 20 from the control unit 10 during the print period, and the update timing of the SP latch, the SIL latch, the SIM latch, and the SIH latch before and after transition from the print period to the check period. Although FIG. 8 illustrates an example in which the drive signal COM-C is supplied from the control unit 10, the drive signal COM-C may not be supplied since the drive signal COM-C is not selected as the drive signals Vout-1 to Vout-m during the print period. Although FIG. 9 illustrates an example in which the drive signal COM-A is supplied from the control unit 10, the drive signal COM-A may not be supplied since the drive signal COM-A is not selected as the drive signals Vout-1 to Vout-m during the check period.

As illustrated in FIG. 7, the drive signal selection section 72 includes m decoders DEC-1 to DEC-m. The control signal LAT, the control signal CH, and the program data SP-1 to SP-30 held by the SP-1 to SP-30 latches are input in common to the m decoders DEC-1 to DEC-m. The 3-bit print data (SIH-i, SIM-i, SIL-i) (i is 1 to m) held by the SIH-i latch, the SIM-i latch, and the SIL-i latch is input to the ith decoder DEC-i. The decoder DEC-i outputs a control signal Sa-i that controls selection/non-selection of the drive signal COM-A, a control signal Sb-i that controls selection/non-selection of the drive signal COM-B, and a control signal Sc-i that controls selection/non-selection of the drive signal COM-C, according to a predetermined decoding logic. In one embodiment of the invention, a common decoding logic is applied to the m decoders DEC-1 to DEC-m.

The drive signal COM-A, the drive signal COM-B, or the drive signal COM-C selected by the control signal Sa-i, the control signal Sb-i, or the control signal Sc-i is output from the drive signal selection section 72 as the drive signal Vout-i through a transmission gate (analog switch).

Figures 10, 11:
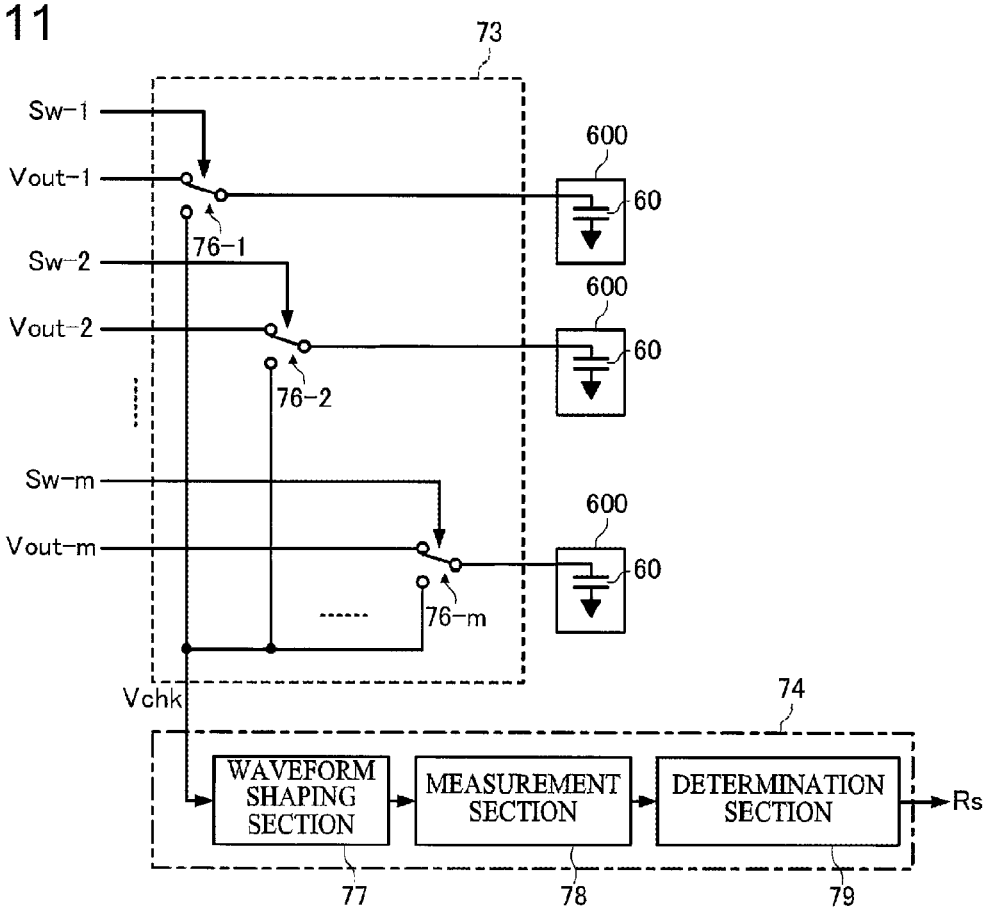
FIG. 10 is a table illustrating a decoding logic applied to a decoder.
FIG. 11 illustrates the configuration of a switch section and an ejection state check section.

FIG. 10 is a table illustrating the decoding logic applied to the decoder DEC-i. As illustrated in FIG. 10, in one embodiment of the invention, the program data SP-1 to SP-6 are fixed at (1, 0, 0, 1, 0, 0), the program data SP-7 to SP-12 are fixed at (1, 0, 0, 0, 1, 0), the program data SP-13 to SP-18 are fixed at (0, 0, 0, 0, 1, 0), the program data SP-19 to SP-24 are fixed at (0, 1, 0, 0, 0, 0), and the program data SP-25 to SP-30 are fixed at (0, 0, 1, 0, 0, 1).

When the 3-bit print data (SIH-i, SIM-i, SIL-i) is (1, 1, 0), the control signal Sa-i is set to a high level according to the program data SP-1 (=1), the control signal Sb-i is set to a low level according to the program data SP-2 (=0), and the control signal Sc-i is set to a low level according to the program data SP-3 (=0) during the period T1 that starts at the rising edge of the control signal LAT and ends at the rising edge of the control signal CH. Therefore, the drive signal COM-A (trapezoidal waveform Adp1) is selected as the drive signal Vout-i during the period T1. The control signal Sa-i is set to a high level according to the program data SP-4 (=1), the control signal Sb-i is set to a low level according to the program data SP-5 (=0), and the control signal Sc-i is set to a low level according to the program data SP-6 (=0) during the period T2 that starts at the rising edge of the control signal CH and ends at the rising edge of the control signal LAT. Therefore, the drive signal COM-A (trapezoidal waveform Adp2) is selected as the drive signal Vout-i during the period T2. Therefore, when the 3-bit print data (SIH-i, SIM-i, SIL-i) is (1, 1, 0), the drive signal Vout-i that corresponds to "large dot" (see FIG. 6) is generated.

When the 3-bit print data (SIH-i, SIM-i, SIL-i) is (1, 0, 0), the control signal Sa-i is set to a high level according to the program data SP-7 (=1), the control signal Sb-i is set to a low level according to the program data SP-8 (=0), and the control signal Sc-i is set to a low level according to the program data SP-9 (=0) during the period T1. Therefore, the drive signal COM-A (trapezoidal waveform Adp1) is selected as the drive signal Vout-i during the period T1. The control signal Sa-i is set to a low level according to the program data SP-10 (=0), the control signal Sb-i is set to a high level according to the program data SP-11 (=1), and the control signal Sc-i is set to a low level according to the program data SP-12 (=0) during the period T2. Therefore, the drive signal COM-B (trapezoidal waveform Bdp2) is selected as the drive signal Vout-i during the period T2. Therefore, when the 3-bit print data (SIH-i, SIM-i, SIL-i) is (1, 0, 0), the drive signal Vout-i that corresponds to "medium dot" (see FIG. 6) is generated.

When the 3-bit print data (SIH-i, SIM-i, SIL-i) is (0, 1, 0), the control signal Sa-i is set to a low level according to the program data SP-13 (=0), the control signal Sb-i is set to a low level according to the program data SP-14 (=0), and the control signal Sc-i is set to a low level according to the program data SP-15 (=0) during the period T1. Therefore, the drive signals COM-A, COM-B, and COM-C are not selected during the period T1, and one end of the piezoelectric element 60 is set to an open state. However, the drive signal Vout-i is maintained at the voltage Vc due to the capacitive characteristics of the piezoelectric element 60. The control signal Sa-i is set to a low level according to the program data SP-16 (=0), the control signal Sb-i is set to a high level according to the program data SP-17 (=1), and the control signal Sc-i is set to a low level according to the program data SP-18 (=0) during the period T2. Therefore, the drive signal COM-B (trapezoidal waveform Bdp2) is selected as the drive signal Vout-i during the period T2. Therefore, when the 3-bit print data (SIH-i, SIM-i, SIL-i) is (0, 1, 0), the drive signal Vout-i that corresponds to "small dot" (see FIG. 6) is generated.

When the 3-bit print data (SIH-i, SIM-i, SIL-i) is (0, 0, 0), the control signal Sa-i is set to a low level according to the program data SP-19 (=0), the control signal Sb-i is set to a high level according to the program data SP-20 (=1), and the control signal Sc-i is set to a low level according to the program data SP-21 (=0) during the period T1. Therefore, the drive signal COM-B (trapezoidal waveform Bdp1) is selected as the drive signal Vout-i during the period T1. The control signal Sa-i is set to a low level according to the program data SP-22 (=0), the control signal Sb-i is set to a low level according to the program data SP-23 (=0), and the control signal Sc-i is set to a low level according to the program data SP-24 (=0) during the period T2. Therefore, the drive signals COM-A, COM-B, and COM-C are not selected during the period T2, and one end of the piezoelectric element 60 is set to an open state. However, the drive signal Vout-i is maintained at the voltage Vc due to the capacitive characteristics of the piezoelectric element 60. Therefore, when the 3-bit print data (SIH-i, SIM-i, SIL-i) is (0, 0, 0), the drive signal Vout-i that corresponds to "non-recording" (see FIG. 6) is generated.

When the 3-bit print data (SIH-i, SIM-i, SIL-i) is (0, 0, 1), the control signal Sa-i is set to a low level according to the program data SP-25 (=0), the control signal Sb-i is set to a low level according to the program data SP-26 (=0), and the control signal Sc-i is set to a high level according to the program data SP-27 (=1) during the period T1. Therefore, the drive signal COM-C (trapezoidal waveform Cdp1) is selected as the drive signal Vout-i during the period T1. The control signal Sa-i is set to a low level according to the program data SP-28 (=0), the control signal Sb-i is set to a low level according to the program data SP-29 (=0), and the control signal Sc-i is set to a high level according to the program data SP-30 (=1) during the period T2.

In one embodiment of the invention, since the pulse of the LAT signal is transmitted from the control section 100 in each cycle Tb during the check period, the print data (SIH-i, SIM-i, SIL-i) is updated in each cycle Tb. When the print data (SIH-i, SIM-i, SIL-i) is (0, 0, 1) ("check") during the period T1, the print data (SIH-i, SIM-i, SIL-i) necessarily is (0, 0, 0) ("non-recording") during the subsequent period T2. Therefore, when the print data (SIH-i, SIM-i, SIL-i) is (0, 0, 1) during the period T1, the period T1 check drive signal Vout-i (see FIG. 6) is generated. When the print data (SIH-i, SIM-i, SIL-i) is (0, 0, 1) ("check") during the period T2, the print data (SIH-i, SIM-i, SIL-i) is necessarily (0, 0, 0) ("non-recording") during the preceding period T1. Therefore, when the 3-bit print data (SIH-i, SIM-i, SIL-i) is (0, 0, 1) during the period T2, the period T2 check drive signal Vout-i (see FIG. 6) is generated.

As illustrated in FIG. 7, the drive signal selection section 72 outputs a signal that represents the result obtained by calculating the logical AND of each of the m control signals Sc-1 to Sc-m and the control signal RT to the switch section 73 as the m selection signals Sw-1 to Sw-m. Since the m control signals Sc-1 to Sc-m are set to a low level during the print period, the m selection signals Sw-1 to Sw-m are set to a low level. When the ith (i is 1 to m) ejecting section 600 is the check target during the check period, the selection signal Sw-i coincides with the control signal RT since the control signal Sc-i is set to a high level, and the selection signal Sw-j is set to a low level since the jth (j is 1 to m other than i) control signal Sc-j is set to a low level. The control signal RT is set to a low level during the print period. During the check period, the control signal RT is set to a low level during a predetermined period that includes the start timing of the period T1 or T2 and the trapezoidal waveform Cdp1 or Cdp2, and is then maintained at a high level until the period T1 or T2 ends.

7. Configuration of Switch Section and Ejection State Check Section

FIG. 11 illustrates the configuration of the switch section 73 and the ejection state check section 74. As illustrated in FIG. 11, the switch section 73 includes m switches 76-1 to **76-*m* that are respectively connected to one end of the piezoelectric elements 60 respectively included in the m ejecting sections 600, and the m switches 76-1 to 76-*m* are respectively controlled by the selection signals Sw-1 to Sw-m. More specifically, when the selection signal Sw-i (i is 1 to m) is set to a low level, the switch 76-*i* applies the drive signal Vout-i to one end of the piezoelectric element 60 included in the ith ejecting section 600. When the selection signal Sw-i is set to a high level, the switch 76-*i* selects the signal generated at one end of the piezoelectric element 60 included in the ith ejecting section 600 as the residual vibration signal Vchk without applying the drive signal Vout-i to one end of the piezoelectric element 60 included in the ith ejecting section 600. Since the m selection signals Sw-1 to Sw-m are set to a low level during the print period, the drive signals Vout-1 to Vout-m that correspond to "large dot", "medium dot", "small dot", or "non-recording" are respectively supplied to the m ejecting sections 600. During the check period, the drive signal Vout-i (i is 1 to m) that corresponds to "check" is supplied to the ith ejecting section 600 (check target ejecting section) when the selection signal Sw-i is set to a low level (i.e., when the control signal RT is set to a low level), and the signal from the ith ejecting section 600 is selected as the residual vibration signal Vchk when the selection signal Sw-i is set to a high level (i.e., when the control signal RT is set to a high level). The selection signal Sw-j (j is 1 to m other than i) is set to a low level, and the drive signal that corresponds to "non-recording" is supplied to the ejecting section 600 other than the check target ejecting section 600**.

The signal generated at one end of the piezoelectric element 60 included in the check target ejecting section 600 is input to the ejection state check section 74 from the switch section 73 as the residual vibration signal Vchk. As illustrated in FIG. 11, the ejection state check section 74 includes a waveform shaping section 77, a measurement section 78, and a determination section 79.

The waveform shaping section 77 outputs a waveform-shaped signal generated by removing a noise component from the residual vibration signal Vchk using a low-pass filter or a band-pass filter. The waveform shaping section 77 may output the waveform-shaped signal obtained by adjusting the amplitude of the residual vibration signal Vchk using an operational amplifier and a resistor, or may output a low-impedance waveform-shaped signal obtained by subjecting the residual vibration signal Vchk to impedance conversion using a voltage follower.

The measurement section 78 receives the waveform-shaped signal output from the waveform shaping section 77, and measures the frequency (cycle) of the waveform-shaped signal, the amplitude attenuation rate of the waveform-shaped signal, and the like.

The determination section 79 outputs the check result signal Rs that represents the check result as to whether or not the ejection state of the check target ejecting section 600 is abnormal based on the frequency (cycle) of the waveform-shaped signal, the amplitude attenuation rate of the waveform-shaped signal, and the like that have been measured by the measurement section 78. The check result signal Rs may be a binary signal that represents whether or not the ejection state is abnormal. The check result signal Rs may be a signal that represents information that represents whether or not the ejection state is abnormal, and also represents the cause (i.e., (1) air bubbles have been formed within (have entered) the cavity 631, or (2) the ink within the cavity 631 has increased in viscosity or become immobilized due to drying or the like, or (3) a foreign substance (e.g., paper powder) has adhered to an area around the outlet of the nozzle 651) of the abnormal ejection state when the ejection state is abnormal.

8. Advantageous Effects

According to the liquid ejecting device 1, since the SP data held by the SP shift register and the SI data held by the SI shift register are indefinite at a timing before a check is performed, the check target designation data management section 71 can update the SP data and the SI data by shifting and holding the first data that is included in the check target designation data and designates the first check target ejecting section 600 (mth ejecting section 600) in the first management mode. The check target designation data management section 71 can then update the SI data held by the SI shift register without updating the SP data held by the SP shift register by shifting and holding the second data that is included in the check target designation data and designates the subsequent check target ejecting section 600 (first to (m−1)th ejecting sections 600) in the second management mode.

In particular, since the check target designation data management section 71 shifts the designation of the check target ejecting section by shifting and holding the 1-bit second data in the second management mode, it is possible to significantly shorten the time required for the check target designation data management section 71 to perform the data management process (i.e., the time required to designate the check target ejecting section) during the check period. According to the liquid ejecting device 1, since it is possible to shorten the time required to designate the check target ejecting section 600 even when the number of ejecting section 600 is large, and shorten the check cycle Tb (i.e., so as to be half of the print cycle Ta), it is possible to quickly check the state of the m ejecting sections 600.

According to the liquid ejecting device 1, since the time required to designate the check target ejecting section 600 is constant (i.e., a time corresponding to one cycle of the pulse of the clock signal Sck) independently of the number of ejecting sections 600, it is unnecessary to increase the check cycle Tb even when the number of ejecting sections 600 is increased. Therefore, it is possible to implement a quick check while achieving high resolution.

According to the liquid ejecting device 1, since it is possible to take measures using the maintenance process (cleaning process or wiping process) or the complementary recording process when the state of the ejecting section 600 is abnormal, it is possible to reduce the amount of waste (print medium P), and improve productivity with regard to the print medium P. In particular, since it is possible to reduce the amount of waste (print medium P) without stopping printing by taking measures using the complementary recording process when the state of the ejecting section 600 is abnormal, it is possible to implement high-speed printing while improving productivity.

9. Modifications

First Modification

Figure 12:
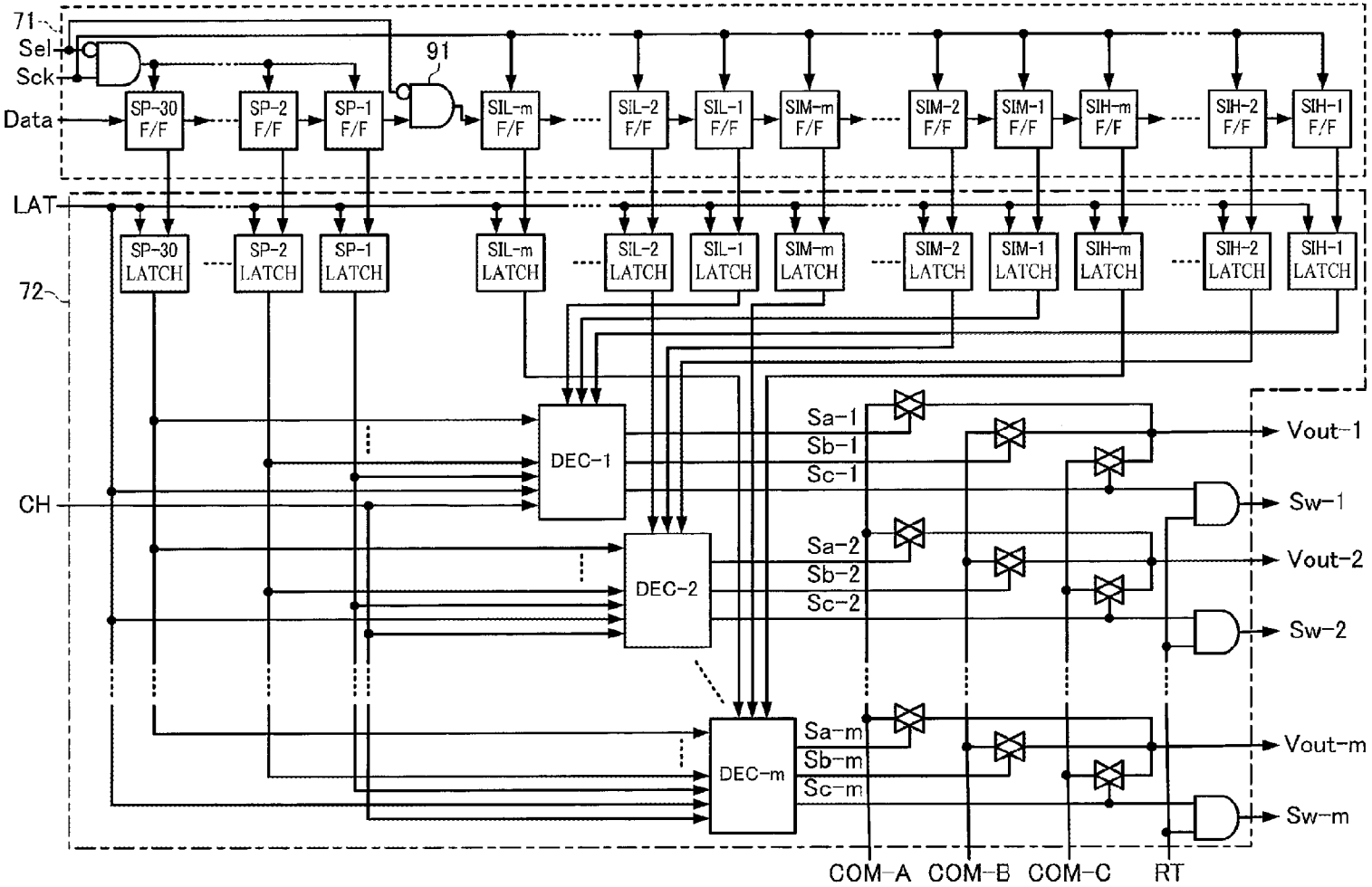
FIG. 12 illustrates the configuration of an ejection selection section according to the first modification.

Although the embodiments have been described above taking an example in which the data signal Data that includes the second data ("0") (i.e., check target designation data) is transmitted from the control section 100 to the check target designation data management section 71, the second data may not be transmitted from the control section 100. For example, when a pulse of the clock signal Sck has been input to the check target designation data management section 71 in a state in which the control signal Sel is set to a high level, low-level data is necessarily input to the SI shift register, and a 1-bit shift is performed independently of the data signal Data. FIG. 12 illustrates the configuration of the ejection selection section 70 according to the first modification. The configuration of the drive signal selection section 72 illustrated in FIG. 12 is the same as the configuration of the drive signal selection section 72 illustrated in FIG. 7. The check target designation data management section 71 illustrated in FIG. 12 differs from the check target designation data management section 71 illustrated in FIG. 7 in that an AND circuit 91 is provided instead of the switch 75. Since the AND circuit 91 is provided, the signal input to the SIL-m flip-flop is set to a low level when the control signal Sel is set to a high level. The second data that is set to a low level is input to the SIL-m flip-flop at the edge timing of the clock signal Sck, and the SI shift register shifts the data by 1 bit. The control signal Sel that is set to a high level and the clock signal Sck that includes one pulse are transmitted from the control section 100 in each cycle Tb during the check period, and the check target designation data management section 71 shifts and holds (manages) the second data that is set to a low level, so that the m ejecting sections 600 are sequentially checked.

Second Modification

Although the embodiments have been described above taking an example in which the m-bit print data SIH-1 to SIH-m, the m-bit print data SIM-1 to SIM-m, the m-bit print data SIL-1 to SIL-m, and the 30-bit program data SP-1 to SP-30 are sequentially transmitted to the check target designation data management section 71 from the control section 100, the print data SI may be transmitted as described below. In this case, the configuration of the check target designation data management section 71 differs from that described above in connection with the embodiments (see FIG. 7).

Figure 13:
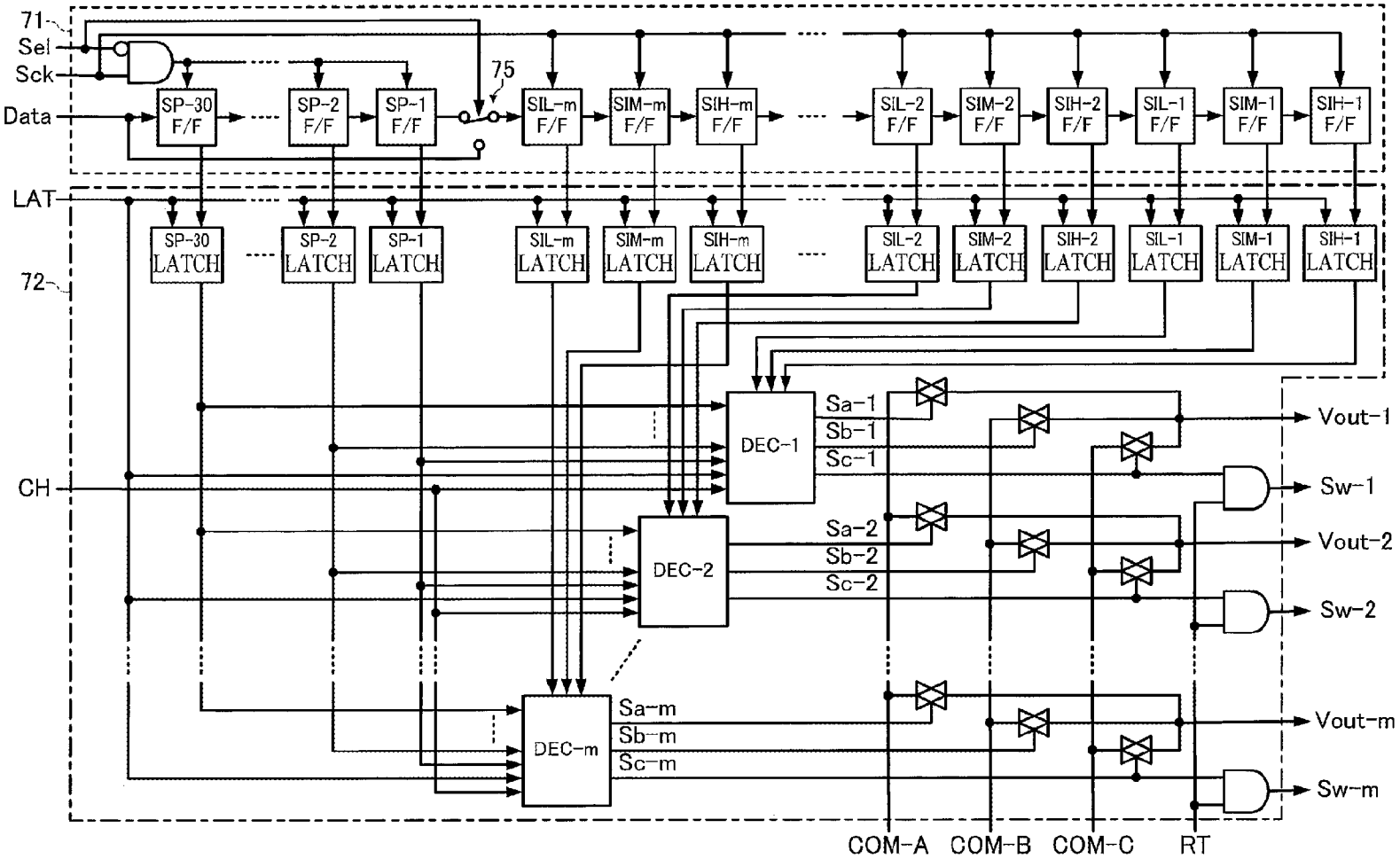
FIG. 13 illustrates the configuration of an ejection selection section according to the second modification.
Figure 14:
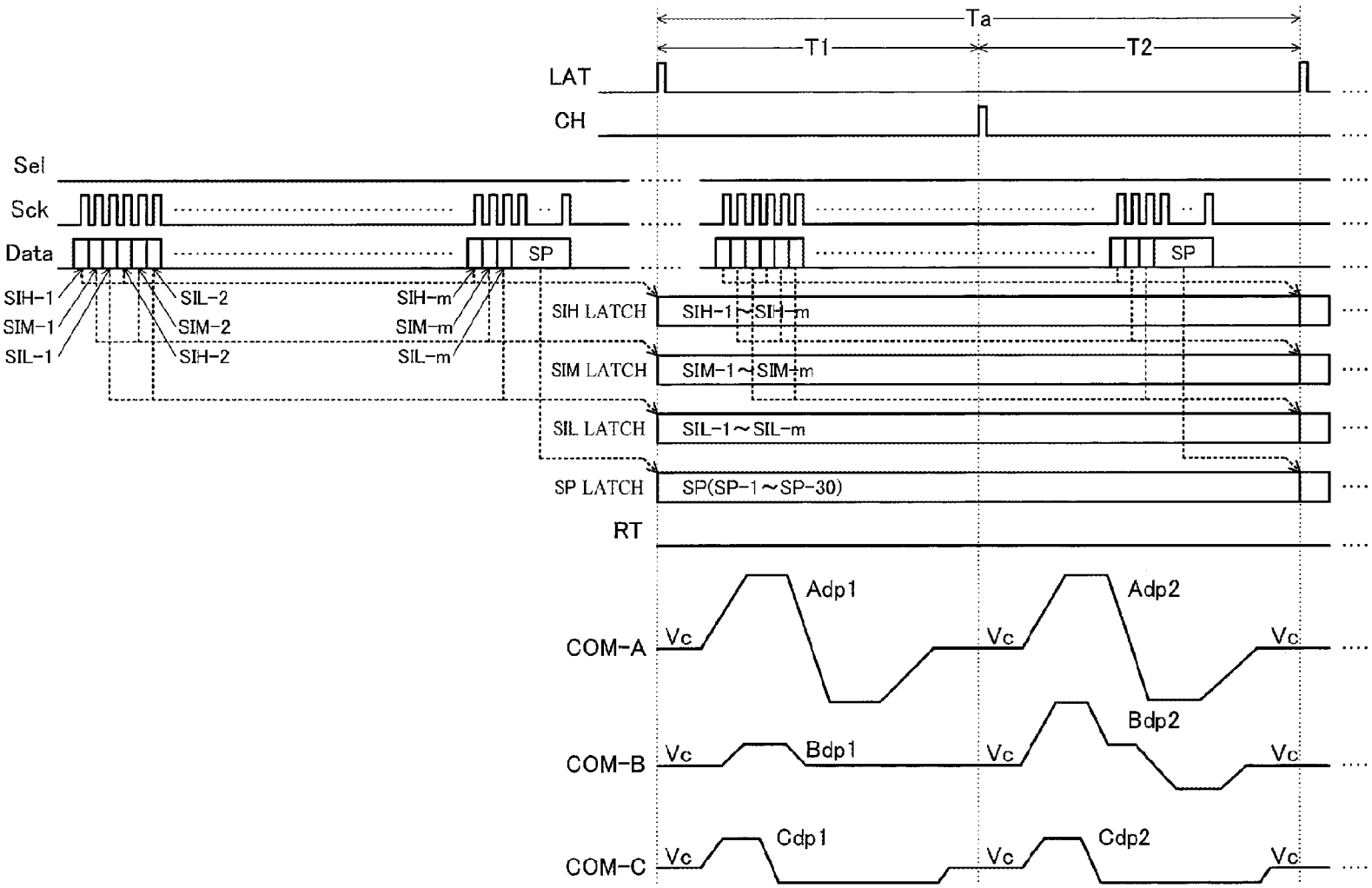
FIG. 14 illustrates the waveform of each signal supplied to a head unit, and the update timing of each latch during a print period according to the second modification.
Figure 15:
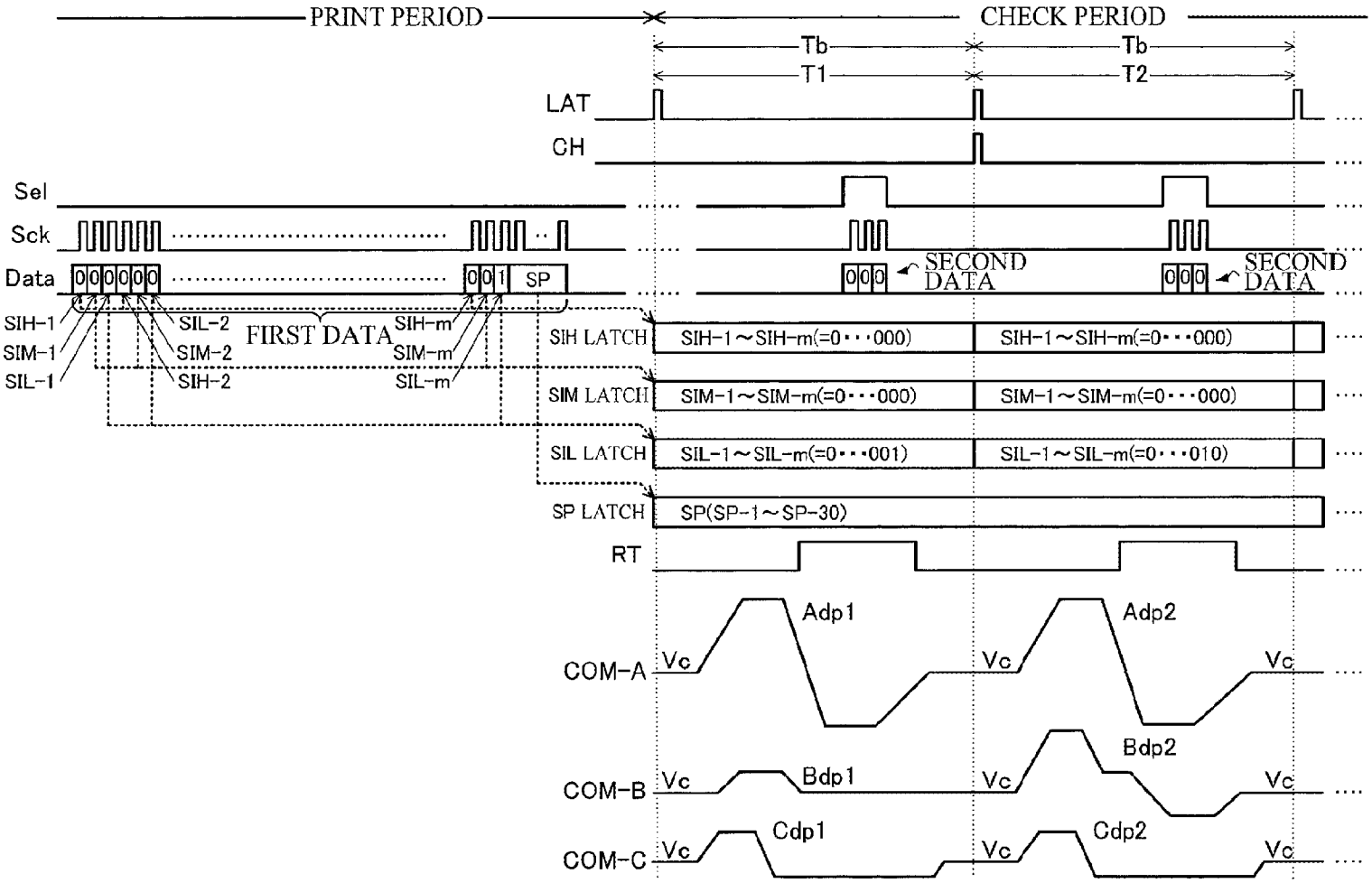
FIG. 15 illustrates the waveform of each signal supplied to a head unit, and the update timing of each latch before and after transition from a print period to a check period according to the second modification.

FIG. 13 illustrates the configuration of the ejection selection section 70 according to the second modification. FIG. 14 illustrates the waveform of each signal supplied to the head unit 20 from the control unit 10, and the update timing of the SP latch, the SIL latch, the SIM latch, and the SIH latch during the print period when the second modification is employed. FIG. 15 illustrates the waveform of each signal supplied to the head unit 20 from the control unit 10, and the update timing of the SP latch, the SIL latch, the SIM latch, and the SIH latch before and after transition from the print period to the check period when the second modification is employed.

As illustrated in FIG. 13, the check target designation data management section 71 according to the second modification has a configuration in which a 3m-bit SI shift register is provided in the subsequent stage of the 30-bit SP shift register, the 3m-bit SI shift register having a configuration in which 3m flip-flops that hold the 3-bit print data (SIL-m, SIM-m, SIH-m) that is supplied to the mth ejecting section 600, . . . , the 3-bit print data (SIL-2, SIM-2, SIH-2) that is supplied to the second ejecting section 600, and the 3-bit print data (SIL-1, SIM-1, SIH-1) that is supplied to the first ejecting section 600, are sequentially connected. The configuration (electrical connection relationship) of the drive signal selection section 72 illustrated in FIG. 13 is the same as the configuration of the drive signal selection section 72 illustrated in FIG. 7.

As illustrated in FIGS. 14 and 15, the control section 100 sequentially transmits the 3-bit print data (SIH-1, SIM-1, SIL-1) that is supplied to the first ejecting section 600, the 3-bit print data (SIH-2, SIM-2, SIL-2) that is supplied to the second ejecting section 600, . . . , and the 3-bit print data (SIH-m, SIM-m, SIL-m) that is supplied to the mth ejecting section 600, and the 30-bit program data SP-1 to SP-30 as the print data SI and the program data SP used during the print period, or the first data used during the check period. The control section 100 transmits the control signal Sel that is set to a low level together with the print data SI and the program data SP used during the print period, or the first data used during the check period, and the check target designation data management section 71 is set to the first management mode. The check target designation data management section 71 holds the data using the 3m-bit SI shift register and the 30-bit SP shift register in synchronization with (3m+30) pulses of the clock signal Sck, and the data is latched at the rising edge of the control signal LAT.

As illustrated in FIG. 15, the 3-bit print data (SIH-m, SIM-m, SIL-m) included in the first data used during the check period that is supplied to the mth ejecting section 600 is (0, 0, 1) ("check"), and the first data is latched at the rising edge of the control signal LAT so that the mth ejecting section 600 is checked during the first period T1. The control section 100 then transmits a 3-bit fixed value "000" (second data) together with the control signal Sel that is set to a high level and the clock signal Sck that includes three pulses in each cycle Tb. The check target designation data management section 71 is thus set to the second management mode, the 3-bit fixed value "000" is sequentially input to the SIL-m flip-flop at the edge timing of the clock signal Sck, and the SI shift register shifts the data by 1 bit (3 bits in total). Therefore, the m ejecting sections 600 are sequentially checked in each cycle Tb during the check period.

Third Modification

Although the embodiments have been described above taking an example in which whether or not the ejection state of the ejecting section 600 is abnormal is checked based on residual vibrations, another configuration may also be employed. For example, the drive signal Vout that instructs to eject an ink may be applied to the m ejecting sections 600 according to a check instruction from the host computer to form a nozzle check pattern on the print medium P. When the user has determined that the ejection state is abnormal from the nozzle check pattern formed on the print medium P, the user may effect the maintenance process (e.g., cleaning process or wiping process).

Fourth Modification

Although the embodiments have been described above taking an example in which the driver circuits 50-*a*, 50-*b*, and 50-*c* respectively generate the drive signals COM-A, COM-B, and COM-C, the driver circuit 50-*a* may generate the drive signal COM-A during the print period, and generate the drive signal COM-C during the check period since the drive signal COM-C is not used during the print period, and the drive signal COM-A is not used during the check period. In this case, the program data SP used during the print period may be data for generating the drive signal Vout that corresponds to "large dot", "medium dot", "small dot", or "non-recording" from the drive signals COM-A and COM-B, and the program data SP included in the first data used during the check period may be data for generating the drive signal Vout that corresponds to "check" or "non-recording" from the drive signals COM-B and COM-C. In this case, the print data supplied to each of the m ejecting sections 600 may be 2-bit data. Therefore, it is unnecessary to provide the driver circuit 50-*c*, and the configuration of the check target designation data management section 71 and the drive signal selection section 72 can be simplified.

The embodiments of the invention and the modifications thereof have been described above. Note that the invention is not limited to the above embodiments and modifications thereof. Various modifications and variations may be made without departing from the scope of the invention. For example, the above embodiments and modifications thereof may be appropriately combined.

The invention includes various other configurations substantially the same as the configurations described above in connection with the embodiments (e.g., a configuration having the same function, method, and results, or a configuration having the same objective and effects). The invention also includes a configuration in which an unsubstantial element described above in connection with the embodiments is replaced by another element. The invention also includes a configuration having the same effects as those of the configurations described above in connection with the embodiments, or a configuration capable of achieving the same objective as that of the configurations described above in connection with the embodiments. The invention further includes a configuration in which a known technique is added to the configurations described above in connection with the embodiments.

REFERENCE SIGNS LIST

1: liquid ejecting device, 2: moving element, 3: moving mechanism, 4: feed mechanism, 10: control unit, 20: head unit, 24: carriage, 31: carriage motor, 32: carriage guide shaft, 33: timing belt, 35: carriage motor driver, 40: platen, 41: feed motor, 42: feed roller, 45: feed motor driver, 50-*a*, 50-*b*, 50-*c*: driver circuit, 60: piezoelectric element, 70: ejection selection section, 71: check target designation data management section, 72: drive signal selection section, 73: switch section, 74: ejection state check section, 75: switch, 76-1 to 76-*m*: switch, 77: waveform shaping section, 78: measurement section, 79: determination section, 80: maintenance unit, 81: cleaning mechanism, 82: wiping mechanism, 90: AND circuit, 91: AND circuit, 100: control section, 101: complementary recording section, 190: flexible cable, 600: ejecting section, 601: piezoelectric material, 611, 612: electrode, 621: diaphragm, 631: cavity, 632: nozzle plate, 641: reservoir, 651: nozzle

The invention claimed is:

1. A liquid ejecting device comprising:

an ejector group that includes a plurality of liquid ejectors that receive a plurality of drive signals and eject a liquid;

an ejection state check circuit that checks a state of a check target liquid ejector that is a liquid ejector among the plurality of liquid ejectors based on a residual vibration signal output from the check target liquid ejector; and a check target designation data management circuit that manages check target designation data that designates the check target liquid ejector, the check target designation data management circuit including a first data-holding circuit and a second data-holding circuit, and having a first management mode in which the check target designation data management circuit updates data held by the first data-holding circuit and data held by the second data-holding circuit, and a second management mode in which the check target designation data management circuit updates the data held by the second data-holding circuit without updating the data held by the first data-holding circuit.

2. The liquid ejecting device as defined in claim 1, the check target designation data held by the first data-holding circuit being used for selecting a liquid ejector to be driven from the plurality of liquid ejectors, and the check target designation data held by the second data-holding circuit being used for selecting part of the drive signal.

3. The liquid ejecting device as defined in claim 1, the first data-holding circuit being a first shift register, the second data-holding circuit being a second shift register, in the first management mode, the check target designation data being input to the first shift register, the first shift register shifting the input check target designation data, and the second shift register shifting the data output from the first shift register to update the data held by the second shift register, and in the second management mode, the check target designation data being input to the second shift register, and the second shift register shifting the input check target designation data to update the data held by the second shift register.

4. The liquid ejecting device as defined in claim 3, the second shift register being an N-bit (where, N is a natural number equal to or larger than 1) register, in the first management mode, the second shift register holding the data output from the first shift register in a state in which the data is shifted by N bits, and in the second management mode, the second shift register holding the input check target designation data in a state in which the check target designation data is shifted by a number of bits that is smaller than N bits.

5. The liquid ejecting device as defined in claim 1, the first data-holding circuit being a first shift register, the second data-holding circuit being a second shift register, in the first management mode, the second shift register being connected to an output of the first shift register, and the check target designation data being input to the first shift register, and in the second management mode, the second shift register not being connected to the output of the first shift register, and the check target designation data being input to the second shift register.

6. The liquid ejecting device as defined in claim 1, the first management mode being used for a first check, and the second management mode being used for a consecutive check.

7. The liquid ejecting device as defined in claim 6, in the second management mode, the check target designation data management circuit updating the data held by the second data-holding circuit so that designation of the check target liquid ejector is shifted.

8. The liquid ejecting device as defined in claim 1, further comprising:

an abnormal ejection state-resolving circuit that takes measures when the ejection state check circuit has determined that the state of the check target liquid ejector is abnormal.

9. The liquid ejecting device as defined in claim 8, the abnormal ejection state-resolving circuit increasing an ejection volume of the liquid from a liquid ejector among the plurality of liquid ejectors other than the check target liquid ejector when the ejection state check circuit has determined that the state of the check target liquid ejector is abnormal.

10. The liquid ejecting device as defined in claim 8, the abnormal ejection state-resolving circuit including at least one of a cleaning mechanism, a wiping mechanism, and a complementary recording mechanism.

* * * * *